US007557801B2

(12) United States Patent
Ozaki

(10) Patent No.: US 7,557,801 B2
(45) Date of Patent: Jul. 7, 2009

(54) DISPLAY DEVICE AND DRIVING METHOD THEREOF

(75) Inventor: Tadafumi Ozaki, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 775 days.

(21) Appl. No.: 10/844,402

(22) Filed: May 13, 2004

(65) Prior Publication Data

US 2005/0035981 A1 Feb. 17, 2005

(30) Foreign Application Priority Data

May 16, 2003 (JP) ..... 2003-139607

(51) Int. Cl.
*G09G 5/00* (2006.01)

(52) U.S. Cl. ..... 345/204; 345/98; 345/571; 345/690

(58) Field of Classification Search ..... 345/36, 345/45, 48, 76, 82–87, 90–100, 204, 214, 345/532, 534, 536, 564–567, 571, 574, 690
See application file for complete search history.

(56) References Cited

U.S. PATENT DOCUMENTS 5,945,972 A * 8/1999 Okumura et al. ..... 345/98
6,011,535 A 1/2000 Katoh et al.
6,344,843 B1 2/2002 Koyama et al.
6,587,086 B1 * 7/2003 Koyama ..... 345/77
6,753,834 B2 * 6/2004 Mikami et al. ..... 345/76
6,791,129 B2 * 9/2004 Inukai ..... 257/208
2004/0032382 A1 * 2/2004 Cok et al. ..... 345/82

OTHER PUBLICATIONS

R.H. Friend et al., *Current Status and Future of Light-Emitting Polymer Display Driven by Poly-Si TFT*, SID 99 Digest, pp. 372-375.
Shimoda et al., *High Resolution Light Emitting Polymer Display Driven by Low Temperature Polysilicon Thin Film Transistor with Integrated Driver*, Asia Display '98: Proceedings of the 18th International Display Research Conference, 1998, pp. 217-220.
Han et al., *3.8 inch Green OLED with Low Temperarure Poly Si TFT*, EuroDisplay '99: Proceedings of the 19th International Display Research Conference, Late-News Papers, Sep. 6-9, 1999, pp. 27-30.

* cited by examiner

*Primary Examiner*—Richard Hjerpe
*Assistant Examiner*—Mansour M Said
(74) *Attorney, Agent, or Firm*—Eric J. Robinson; Robinson Intellectual Property Law Office, P.C.

(57) ABSTRACT

In a display device and a control circuit thereof, mounting of a high-capacity memory device for synchronizing the reception cycle of a digital image signal with a drive cycle of the display device or for translating a format of a received digital image signal into a format to be displayed by the display device is avoided, while transmission volume of digital image signals to the display device is reduced to achieve downsizing and power saving. In a display device having a plurality of memory circuits in a pixel, a digital image signal is written into a memory circuit in the pixel using a decoder, whereby digital image data that is received without the use of a high-capacity memory device can be displayed even when the digital image signal is received in an arbitrary cycle. Further, by providing an image processing register in a control circuit of the display device and dividing the pixels of the display device into a plurality of pixel sections, image processing can be performed per pixel section, which leads to reduction in transmission volume of images.

25 Claims, 17 Drawing Sheets a : CLOCK
b : ADDRESS
c : 1ST INSIDE ADDRESS
d : 2ND INSIDE ADDRESS
e : OUTPUT OF $m_1$ BIT DECODER
f : OUTPUT OF FRIP-FROP CIRCUIT FOR 1ST DECODE SIGNAL LATCH CIRCUIT
g : OUTPUT OF $m_2$ BIT DECODER
h : OUTPUT OF $m_n$ BIT DECODER

DISPLAY DEVICE AND DRIVING METHOD THEREOF

BACKGROUND OF THE INVENTION

1. Field of the Invention

The present invention relates to a driving circuit of a display device and a control system of the driving circuit. More particularly, the invention relates to an active matrix light emitting device comprising a thin film transistor formed over an insulating substrate, wherein each pixel of the display device includes a plurality of volatile or non-volatile memory holding devices each including the thin film transistor. In addition, the invention relates to an active matrix display device using a light emitting element such as an organic electroluminescence (EL) element as a display element of the display device.

2. Description of Related Art

FIG. 12 illustrates an example of a conventional digital display device. A source signal line driving circuit 101, gate signal line driving circuits 102, a shift register circuit 103, a first latch circuit 104, a second latch circuit 105, a power supply line 106, a pixel portion 107 and the like are disposed. The source signal line driving circuit 101 has a configuration as shown in FIG. 13. Note that the gate signal line driving circuits 102 are disposed on both of the right and left sides of the pixel portion in FIG. 12.

The operation thereof is described in brief with reference to FIGS. 12 and 13. First, a clock signal (S-CLK and S-CLKb) and a start pulse (S-SP) are inputted to the shift register circuit 103 (represented by SR(201) in FIG. 13), and sampling pulses are sequentially outputted. Subsequently, the sampling pulses are inputted to the first latch circuit 104 (represented by LAT1(202) in FIG. 13), whereby all of digital video signals (Digital Data) inputted to the first latch circuit 104 are held therein. Once holding of each of one-bit digital video signals for one horizontal cycle is completed in the first latch circuit 104, the digital video signals held in the first latch circuit 104 are transferred to the second latch circuit 105 (represented by LAT2(203) in FIG. 13) all at once in accordance with the input of a latch signal (Latch Pulse).

Meanwhile in the gate signal line driving circuits 102, a gate side clock signal (G-CLK) and a gate side start pulse (G-SP) are inputted to a shift register (not shown) therein. The shift register sequentially outputs pulses based on the input signals. These pulses are outputted as gate signal line selection pulses, whereby gate signal lines are sequentially selected.

Data transferred to the second latch circuit 105 of the source signal line driving circuit 101 is written to a pixel (represented by Pixel(204) in FIG. 13) in columns that are selected by the gate signal line selection pulses.

The drive of the pixel portion 107 is described now. FIG. 14 illustrates a part of the pixel portion 107 in FIG. 12. FIG. 14A illustrates a matrix of 3×3 pixels. A portion surrounded by a dotted frame 300 corresponds to one pixel, which is shown in an enlarged view of FIG. 14B. When a voltage is applied to the gate electrode of a switching TFT 301, the switching TFT 301 is turned ON. Then, a signal (voltage) of a source signal line 306 is accumulated in a storage capacitor 304. A voltage of the storage capacitor 304 is the gate-source voltage $V_{GS}$ of an EL driving TFT 302, therefore, a current corresponding to the voltage of the storage capacitor 304 flows into the EL driving TFT 302 and an EL element 303. Consequently, the EL element 303 emits light.

When a gate signal line 305 is not selected, the gate of the switching TFT 301 is closed, and the switching TFT 301 is thus turned OFF. At this time, a charge accumulated in the storage capacitor 304 is held. Accordingly, the $V_{GS}$ of the EL driving TFT 302 remains to be held, and a current corresponding to the $V_{GS}$ keeps on flowing into the EL element 303 through the EL driving TFT 302. Note that one end of the storage capacitor 304 is connected to a power supply line 307 in FIG. 14B, however, an alternative dedicated wiring may be used.

As for the drive and the like of an EL element, various reports have been given so far (see Non-Patent Documents 1 to 3, for example).

Non-Patent Document 1

SID99 Digest: P372: "Current Status and future of Light-Emitting Polymer Display Driven by Poly-Si TFT"

Non-Patent Document 2

ASIA DISPLAY98: P217: "High Resolution Light Emitting Polymer Display Driven by Low Temperature Polysilicon Thin Film Transistor with Integrated Driver"

Non-Patent Document 3

Euro Display99 Late News: P27: "3.8Green OLED with Low Temperature Poly-Si TFT"

Now, a gray scale method of an EL element is described. Among gray scale methods of an EL element, there is known a time gray scale method. The time gray scale method is a method in which lighting period of an EL element is controlled, the time length of which is utilized to express gray scales. That is, one frame period is divided into a plurality of sub-frame periods, and the number and length of the lighting sub-frame periods are controlled to express gray scales.

Referring now to FIG. 15, a drive timing of a circuit using the time gray scale method is described in brief. This is an example where a frame frequency is set at 60 [MHz] and a time gray scale method is applied to a light emitting device having the pixel density of VGA (640×480 pixels) in order to obtain a 3-bit gray scale. As for a source signal line driving circuit, the circuit shown in FIG. 13 is utilized. A period during which one screen is written is referred to as one frame period.

According to the time gray scale method, as shown in FIG. 15A, one frame period is divided into sub-frame periods corresponding to the number of bits for the gray scales. Since 3-bit gray scale is employed here, one frame period is divided into three sub-frame periods (SF1, SF2 and SF3) (FIG. 15B). One sub-frame period is further divided into an address period (Ta) and a sustain (lighting) period (Ts) (FIG. 15B). A sustain period in $SF_1$ is referred to as $T_{S1}$. Similarly, sustain periods in $S_{F2}$ and $S_{F3}$ are referred to as $T_{S2}$ and $T_{S3}$ respectively. In the address period, image signals for one frame are written to pixels, therefore, the address period is the same in length in each of the sub-frame periods (FIG. 15C). Sustain periods satisfies the following relation having the second power: $T_{S1}:T_{S2}:T_{S3}=2^2:2^1:2^0=4:2:1$.

In the address period, gate signals are selected from the first row in sequence, and digital video signals are sequentially written to the respective pixels. In the sustain (lighting) periods $T_{S1}$ to $T_{S2}$, luminance is controlled according to the length of the total lighting periods within one frame period, by controlling an EL element to emit light or not. In this example, $2^3$=8-type lengths of lighting periods can be obtained by the combination of lighting sustain (lighting) periods, therefore, 8 gray scales can be displayed. By utilizing the length of the lighting periods, gray scale display is performed. In the case of increasing the number of gray scales, the division number of one frame may be increased.

In order to perform display by dividing image data for one frame into a plurality of sub-frames like the aforementioned time gray scale method, digital video signals received from outside of the display device is required to be transferred to the display device at an appropriate timing. Therefore, a circuit for modifying the receive timing of digital video signals into the transfer timing thereof to the display device is provided outside of the display device.

SUMMARY OF THE INVENTION

Problems to be Solved by the Invention

An example of a control system of a display device using a time gray scale method is described with reference to FIGS. 16 and 17. FIG. 16 illustrates a block diagram of a control system of a display device using a time gray scale method. Reference numeral 501 represents image data received from outside, and is inputted to a display device control circuit 500. The display device control circuit 500 includes a first memory device 505, a second memory device 506, a format translating part 502 and a display device control part 503. A display portion 509 has a similar configuration to the display device shown in FIG. 12, and it includes a source signal line driving circuit 510, a gate signal line driving circuit 511 and a pixel portion 512. Image data is transferred through an image data bus 508 to the source signal line driving circuit 510. A display device control signal 507 is a signal for controlling the source signal line driving circuit 510 and the gate signal line driving circuit 511. Specifically, it includes a S-CLK (clock signal) and an S-SP (start pulse) for controlling the shift register circuit 103, a Latch Pulse (latch signal) for controlling the second latch circuit 105, and a G-CLK (clock signal) and a G-SP (start pulse) for controlling the gate signal line driving circuit 102 in FIG. 12.

FIGS. 17A and 17B each illustrate a format of image data. It is assumed that in the pixel portion 512 in FIG. 16, the number of pixels for making a distinction between each pixel is represented by n (n is a natural number), and image data transferred to the n-th pixel is represented by An. In addition, the bit width of the gray scale of image data is assumed to be M (M is a natural number). Further, the m-th bit (m is a natural number and $0 \leqq m \leqq M-1$) among the image data An is assumed to be Dnm.

The functions of the display device control system are described now. The received image data 501 in FIG. 16 is inputted to the display device control circuit 500 with a format shown in FIG. 17A. The image data flow shown in FIG. 17A is inputted to the format translating part 502 from the first image data A1 to A2, A3, A4 . . . and A5 so that image data bits are inputted in parallel. On the other hand, an image format inputted to the source signal line driving circuit 510 of the display device 509 is described now. In a display method in which one frame includes K sub-frames (K is a natural number), image data that should be transferred to the I-th pixel in the pixel portion 512 in the address period Tak within the sub-frame period SFk (k is a natural number and $0 \leqq k \leqq K-1$) is DIk (I is a natural number and assuming that N is the total number of the pixels, $0<I<N-1$). The image data is required to be transferred to the source signal line driving circuit 510 per gray scale bit in each of the sub-frames, which means gray scale bits are required to be transferred in series. However, the source signal line driving circuit 510 may employ a method for processing a plurality of pixel addresses in parallel. Accordingly, when gray scale bits are transferred in series to the source signal line driving circuit 510, they may be transferred to a plurality of pixels in parallel. FIG. 17B illustrates an image data format in the case where J (J is a natural number)-pieces of pixel data are transferred in parallel to the source signal line driving circuit 510. That is, the display device control circuit 500 functions to translate the format of the received image data 501 shown in FIG. 17A into the format shown in FIG. 17B, and transfer the format-translated image data and the display device control signal 507 to the display device 509 at an accurate timing.

The operation of the display device control circuit 500 is described now. The received image data 501 is translated into an image data format shown in FIG. 17B in the format translating part 502, and then stored in the first memory device 505 in a certain frame period. At the same time, the display device control part 503 transfers the display control signal 507 to the display device 509, and transfers the image data having the format shown in FIG. 17B that is stored in the second memory device 506 to the source signal line driving circuit 510 through the image data bus 508 at an appropriate timing. In the next frame period, the functions of the first memory device 505 and the second memory device 506 are switched to perform the similar operation to the aforementioned. The switching of the functions of the first memory device 505 and the second memory device 506 is carried out with a synchronous signal 504. However, since the aforementioned display device control circuit is mounted with the two high-capacity memory circuits for storing image data for one frame, it is difficult to achieve downsizing and power saving of a product.

A general active matrix display device performs image display smoothly, therefore, an image screen is updated about 60 times per second as shown in FIG. 15 as described above. That is to say, it is required that digital video signals are supplied to be written to pixels every frame. Even when the image is a still image, the same signals are required to be supplied in succession every frame, therefore, the driving circuit is required to process the same digital image signals in succession.

In the case of adopting a method for storing a digital video signal per pixel by disposing a plurality of memory holding devices in the pixel, the result is as follows. In the conventional driving method, in the case where the whole screen is a still image, once writing is performed, information that is subsequently written to the pixels is the same. Accordingly, a still image can be displayed in succession by reading out the signal stored in the memory device without the need of an input of a signal every frame. However, in the case where a part of the image data is to be changed while another part thereof is to be unchanged, it is still required that all the image data is transferred in order to rewrite the memory holding device disposed in the pixel.

In addition, according to the conventional driving method of a display device, image data has to be transferred to the display device at a synchronous timing with the control signal of the source signal line driving circuit and the gate signal line driving circuit, therefore, the display device control circuit requires the received image data for one frame to be written into a high-capacity memory device having at least a larger number of addresses than the number of pixels.

Power saving and downsizing are regarded as important in particular for portable apparatuses. However, in the conventional display method, image data for the while pixels is required to be transferred to a display device even when a part of the whole still image screen or the whole image screen is moved whereas the rest thereof is kept still. This leads to a problem in saving power of the driving circuit. In addition, in the case where a memory holding device is not disposed in the pixel, the format translating circuit and the two high-capacity memories for temporarily holding the received data that are described in the prior art are required to be mounted. Moreover, even in the case where a memory holding device is disposed in the pixel, the received image data is required to be synchronized with the display timing of the display device, which requires at least one high-capacity memory holding device for holding the received image data for one frame. This results in a problem in downsizing a product.

The display device of the invention is characterized in that it comprises:

pixels each including a light emitting element and a plurality of memory circuits;

a display portion in which a plurality of the pixels is disposed;

a plurality of decoders for controlling the display portion that is disposed around the display portion;

a display control circuit for controlling the decoder;

means for selecting one or more of the memory circuits by the decoder using an electrical signal; and means for writing a digital signal into the memory circuit selected by the decoder.

In addition, the display method of the display device of the invention is characterized in that:

the display control circuit controls a plurality of decoders;

these decoders select one or more of the memory circuits in each of a plurality of pixels disposed in the display portion using an electrical signal; and a light emitting element in each pixel emits light by writing a digital signal into the memory circuit selected by the decoder.

EFFECT OF THE INVENTION

In a display device and a control circuit thereof in accordance with the invention, a pixel including a memory circuit performs display by using a decoder, whereby it is not necessary to mount a high-capacity memory device for storing received image data for one frame externally. In addition, in the case of displaying a still image, image data stored in the memory circuit is only required to be read out in succession and only a part of the pixels may be selected to update image data, which significantly contributes to a reduction in the transmission volume of image data, and downsizing and power saving of a product.

DETAILED DESCRIPTION OF THE INVENTION

Best Mode for Carrying Out the Invention

In this specification, a potential that is higher than the threshold value of an N-channel transistor used in the invention is represented by "0" while a potential that is lower than the threshold value of a P-channel transistor is represented by "1". In addition, in this specification, description is made omitting all the buffers, inverters and the like in the electric circuit in the invention, however, they may be added as needed.

Figure 1:
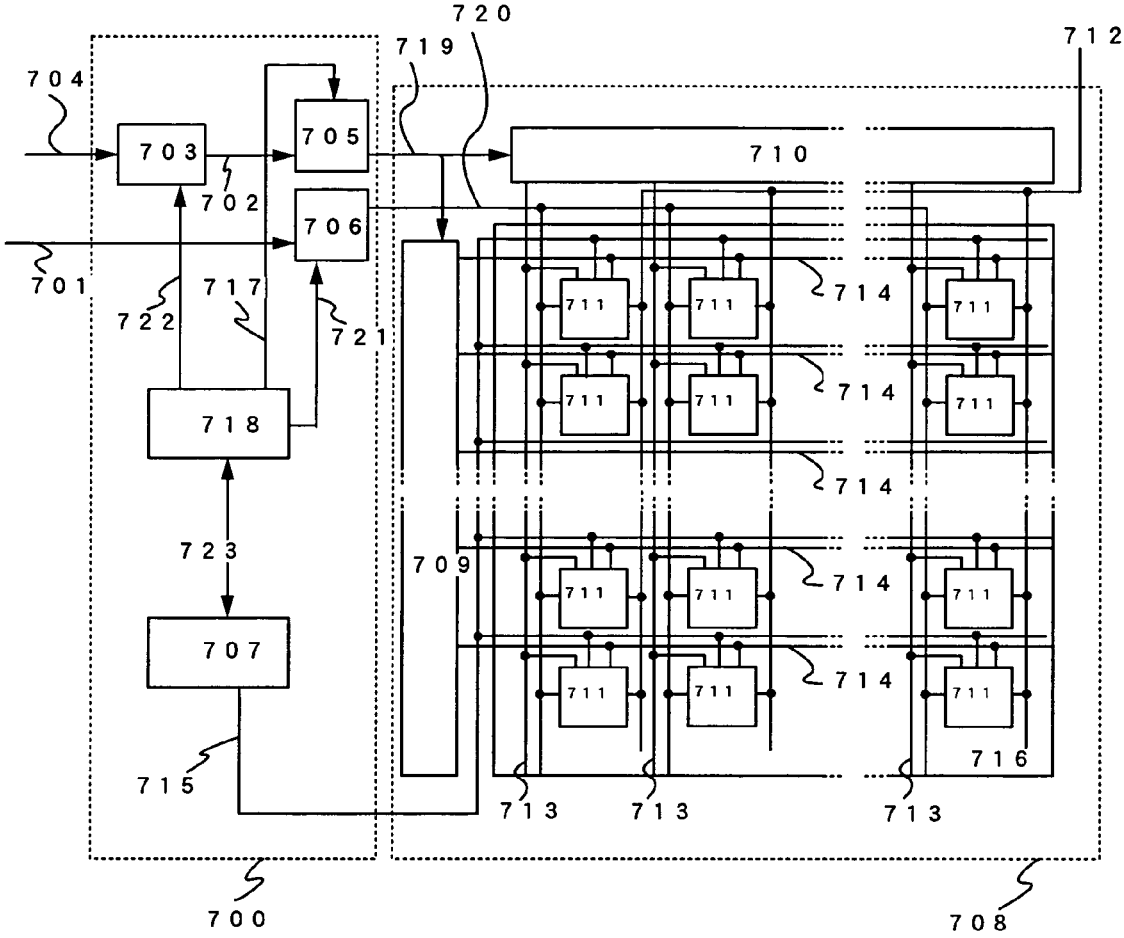
FIG. 1 is a diagram illustrating a circuit configuration of a display device and a control circuit thereof in accordance with the invention.

FIG. 1 illustrates a configuration of a display device in accordance with the invention. A display device 708 includes a column decoder 710, a row decoder 709 and a pixel portion 716. The pixel portion 716 includes pixels 711 arranged in matrix, each of which is disposed with a plurality of memory circuits. A current is supplied through a current supply line 712. Column selection signal lines 713 outputted from the column decoder are inputted to the pixels 711 in the respective columns, while row selection signal lines 714 outputted from the row decoder are inputted to the pixels 711 in the respective rows. A display device control circuit 700 includes an address controller 703, an address latch circuit 705, an image data latch circuit 706 and a display control circuit 707. The address controller is inputted with a synchronous signal 704, and outputs an address bus 702. The address bus is inputted to an address latch circuit 705, and once it is outputted from the address latch circuit, it is divided into two bits, each of which is inputted to the column decoder and the row decoder. Note that the method for dividing the address bus may be in any mode. An image data bus 701 is inputted to the respective pixels 711 through the image data latch circuit 706. The display control circuit 707 inputs a display control signal bus 715 to the respective pixels. A write control circuit 718 outputs an address write control signal 717 and an image data write control signal 721. The address write control signal 717 is inputted to the address latch circuit 705 while the image data write control signal 721 is inputted to the image data latch circuit 706. The display control circuit 707 and the write control circuit 718 are connected through a synchronous signal 723. An address control signal 722 is outputted from the write control circuit 718 and inputted to the address controller 703.

Figure 7A:
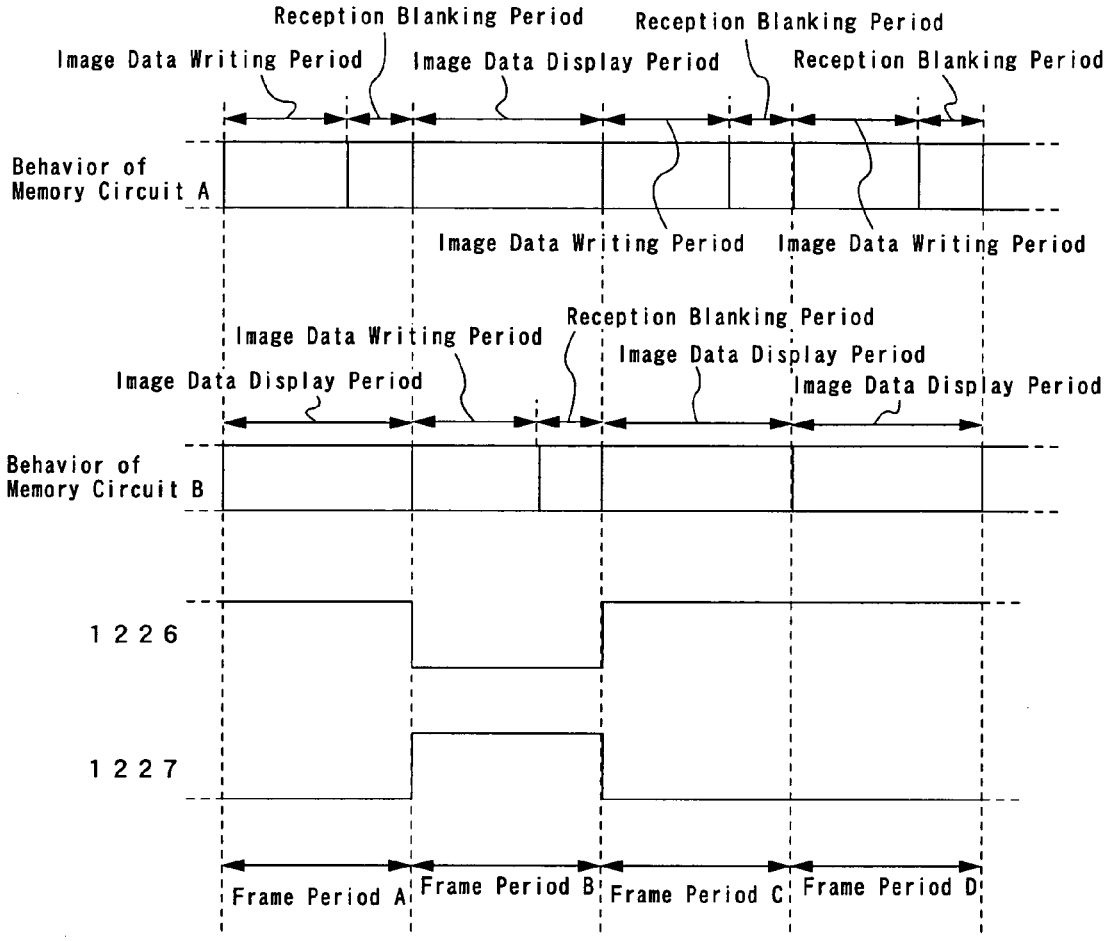
FIGS. 7A-7B are timing charts illustrating operations of a plurality of memory circuits disposed in a pixel per frame.

FIG. 7A illustrates a timing chart of the display device of the invention.

Figure 2:
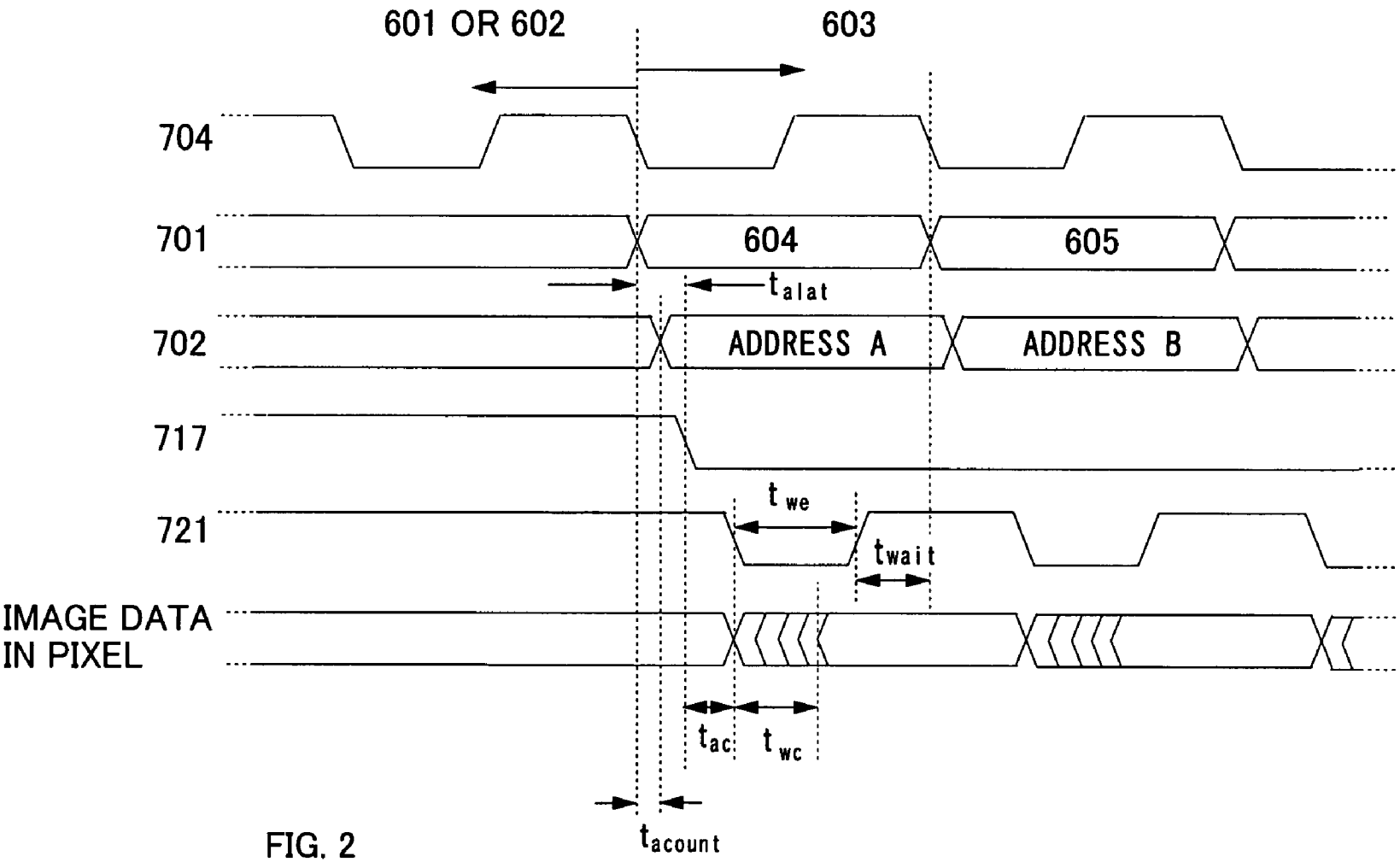
FIG. 2 is a timing chart illustrating writing to a memory circuit disposed in a pixel by a display device control circuit in accordance with the invention.

FIG. 2 illustrates an example of the timing of image data writing to the pixels 711 in FIG. 1.

FIGS. 3, 4, and 5 each illustrate a timing of a frame period and image data reception in each frame period in the display device used in the invention.

Each of the pixels 711 shown in FIG. 1 includes two memory circuits having an identical number of bits to that of the image data. It is assumed that one of the memory circuits is referred to as MA while the other is referred to as MB. A display method for alternately switching the functions of the MA and MB for image data display and for image data writing respectively may be employed, in such a manner that image data is written to the MB while image data of the MB is displayed in a certain frame, and vice versa, image data is written to the MA while image data of the MA is displayed in the next frame. Alternatively, it is assumed that a pixel includes one memory circuit, and the whole pixels are divided into two pixel groups, whereby one of the pixel groups is referred to as an A group while the other is referred to as a B group. In this case, a display method in which pixels in one of the A group and the B group performs display may be employed, in such a manner that data of the memory circuit disposed in the pixels in the A group is displayed while data of the memory circuit disposed in the pixels in the B group is updated in a certain frame, vice versa, the data of the memory circuit disposed in the pixels in the B group is displayed while data of the memory circuit disposed in the pixels in the A group is updated in the next frame. The A group and the B group may be determined, for example, by grouping the pixels in the odd rows into an A group and grouping the pixels in the even rows into a B group.

The operation of the display control circuit shown in FIG. 1 is described now. The operation of the display control circuit 700 of the invention may be divided into a write operation of image data to the memory circuit disposed in the pixel 711, and a display control operation of the image data stored in the memory circuit disposed in the pixel 711. Description is made on the write operation of image data to the memory circuit first. The address latch circuit 705 holds a potential of the address bus 719 or updates the potential of the address bus 719 to a potential of the address bus 702. This operation is controlled by the address write control signal 717. The image data latch circuit 706 holds a potential of the image data bus 701 or updates a potential of the image data bus 720 to the potential of the image data bus 701. This operation is controlled by the image data write control signal 717. First, image data is inputted externally to the display device control circuit 700 through the image data bus 701 in synchronization with the synchronous clock 704. The address controller 703 counts an address and outputs it to the address bus 702 every input of image data. The image data is inputted to the address latch circuit 705 from the address bus 702, and an address potential of the address bus 719 is updated by the control of the address write control signal 717. Further, the address is divided into two bits, each of which is inputted to the row decoder 709 and the column decoder 710 respectively. One of the address bits inputted to the column decoder 710 is decoded, whereby a column selection signal line disposed in the column of which pixel is addressed is selected among column selection signal lines disposed in the columns of the respective pixels of the pixel portion 716. On the other hand, the other address bit inputted to the row decoder 709 is decoded, and a row selection signal line disposed in the row of which pixel is addressed is selected among row selection signal lines disposed in the rows of the respective pixels of the pixel portion 716. Consequently, one pixel that is located in the crossing point of the selected column of the pixel and the selected row of the pixel is selected. Substantially at the same time, a potential of the image data bus 720 is updated to a potential of the image data inputted to the image data bus 701 under the control of the image data write control signal 721. Then, the image data is transferred to the pixel portion 716 and the image data is written into the memory circuit disposed in the pixel that is selected by the address decoding.

FIG. 2 illustrates an example of a write timing of image data to a memory circuit. In FIG. 2, a represents the synchronous clock 704, b represents the image data bus 701, c represents the address bus 702, d represents the address write control signal 717, e represents the image data write control signal 721 and f represents the timing of the data of the memory circuit in the pixel. The address latch circuit 705 outputs an address of the address bus 702 to the address bus 719 when a potential of the control signal for the address latch circuit is "0", and the image data latch circuit 706 outputs image data of the image data bus 701 to the image data bus 720 when a potential of the control signal for the image data latch circuit is "0". The value of an address outputted to the address bus 719 is held when the potential of the control signal for the address latch circuit is "1", and the value of the image data outputted to the image data bus 720 is held when a potential of the control signal for the image data latch circuit is "1", however, it is also possible that the output value of the address latch circuit 705 is updated when the potential of the control signal for the address latch circuit is "1", and the output value of the image data latch circuit 706 is updated when the potential of the control signal for the image data latch circuit is "1". Alternatively, it is possible that the output value of the address latch circuit 705 is updated when the potential of the control signal for the address latch circuit shifts from "1" to "0" or "0" to "1", and the output value of the image data latch circuit 706 is updated when the potential of the control signal for the image data latch circuit shifts from "1" to "0" or "0" to "1". In FIG. 2, $t_{acount}$ represents a delay time that is from the input of image data to the image data bus 701 until the output of an address, which is counted by the address controller 703, to the address bus 702. $t_{alat}$ represents a delay time that is from the input of image data to the image data bus 701 until the address write control signal 717 reaches "0". $t_{ac}$ represents a delay time that is from the output of an address to the address bus 719 until a pixel is selected by decoding. $t_{wc}$ represents a delay time that is from the time at which image data write control signal reaches "0" to determine the image data of the pixel selected by the address decoding. $t_{wc}$ represents a time for keeping the image data write control signal to be "0". $t_{wait}$ represents a time until the next image data is received after the $t_{wc}$ has reached "1".

Description is made now on the write operation of image data to the memory circuit disposed in the pixel 711 in detail with reference to FIG. 2. Image data is inputted from the image data bus 701 in the image data reception period. A reception blanking period 601 represents a period in which reception of image data is intermitted after image data for one frame has been received. In the reception blanking period, any potential of the image data bus 701 does not affect the operation of the display device. The reception blanking period is not necessarily provided. In this specification, a pair of the reception blanking period and reception of image data for one frame is referred to as a reception cycle. A write blanking period 602 represents a period in which image data is received but the received data is not written to the memory circuit in the pixel because of the synchronization with a display period that is described later. First, in the reception blanking period, an address write control signal and an image data write control signal are both set to be "1" so that the data of the memory circuit disposed in the pixel 711 is not updated. In the image reception period, image data A is inputted to the image data bus 701 in synchronization with a synchronous clock. Substantially at the same time, the address controller outputs an address A to the address bus 702, and the write control circuit sets the address write control signal to be "0". Then, when the address is decoded and the memory circuit disposed in the pixel to be written the image data A is selected, the write control circuit sets the image data write control signal to be "0", and the image data A is written to the selected memory circuit in the pixel. At this time, $t_{we}$ is assumed to be longer than $t_{wc}$. After the image data A is written, the address write control signal remains to be "0" in the image data reception period in FIG. 2, however, it may be set to be "1" after the image data writing and to be "1" at the reception of the next image data. In FIG. 2, image data B is transferred in synchronization with a synchronous clock after the writing of the image data A, and $t_{alat}$ at this time is 0. The aforementioned operation is repeated until the completion of the image data reception for one frame period, namely until the image data reception period terminates.

Description is made now on the operation for display control of the image data stored in the memory circuit disposed in the pixel 711. The display control circuit 707 is a circuit for performing display control of the data written to the pixel in the memory circuit. In the display control, a display control signal is outputted to the display control signal bus 715 in order to display the data of the memory circuit disposed in the pixel portion 716. The display is performed with a time division method. Timing of sub-frames is described in embodiment.

Generally, in a display device, one frame period and a cycle in which image data for one frame period is received are different from each other. According to the display device control circuit of the invention, writing of image data to the memory circuit disposed in the pixel 711 is synchronized with the display of image data stored in the memory circuit disposed in the pixel 711 so as to control the display device. The synchronization is performed using the synchronous signal 723. The display device control circuit of the invention is characterized in that it does not require an external high-capacity memory device for the synchronous operation.

Two kinds of synchronous method are considered according to a difference in length of a frame period (hereinafter referred to as $T_f$) and a reception cycle (hereinafter referred to as $T_r$). Now, a value obtained by subtracting $T_f$ from a value of n (n is a natural number) times of $T_r$ is defined t(n). That is, the definition of t(n) is given by the following formula.

$$T(n)=n\times T_r-T_f.$$

Here, it is assumed that n is the positive number and the value where t(n) is the smallest. According to the size of t(n), two synchronous methods are considered. One is the method for intermitting image display until the termination of a reception cycle after a frame period in the case where t(n) is small. The intermission period of image display is referred to as a display blanking period. This synchronous method is hereinafter referred to as a synchronous method A. In the case where the display blanking period is long (when t(n) is large), more flickers of an image screen occur, therefore, the following synchronous method is adopted. That is, display operation is performed without intermission, and in the case where no writing is performed to a memory circuit in a pixel at the beginning of a certain frame period while image data is displayed in the frame, image data of a reception cycle that comes first in the frame is written to the memory circuit in the pixel, whereas in the case where the reception cycle overlaps two frame periods, the same image data is displayed in the two frame periods. This synchronous method is referred to as a synchronous method B. The synchronous method B can be adopted even when t(n) is small enough for flickers of an image screen to be unrecognized in using the synchronous method A. Now, a certain constant $T_h$ is defined as follows. As for the above two kinds of the synchronous methods, the synchronous method A is adopted when t(n) is equal to or smaller than $T_h$, while the synchronous method B is adopted when t(n) is equal to or larger than $T_h$. Information on $T_h$ may be embedded in the display device control circuit of the invention, whereby either of the synchronous method A and the synchronous B may be automatically selected by determining the size of t(n). Alternatively, the synchronous method A and the synchronous method B may be switched using an external switch. Further, it is possible to employ only one of the synchronous method A and the synchronous method B. In this case, the synchronous method A is preferably used by adjusting frame cycles, the number of gray scale bits and the like to make t(n) as small as possible in order to eliminate flickers of an image screen in the display blanking period when a number of moving images are displayed, since the use of the synchronous method A enables a reduction of after-images of moving images rather than the synchronous method B as described later. However, the synchronous method B may be used in the case where no high-speed moving image is required. Alternatively, the synchronous method A may be used in such a manner that a frame period is changed automatically so that t(n) is equal to or smaller than $T_h$ according to a reception cycle. In addition, it is possible to determine a certain range of a frame period, wherein the synchronous method A is used in such a manner that t(n) is equal to or smaller than $T_h$ according to a reception cycle, while the synchronous method B is used in the case where t(n) can not be equal to or smaller than $T_h$ within the range of the frame period.

FIGS. 3, 4 and 5 each illustrate a method for synchronizing a reception cycle of image data with a display cycle of image data that is written to the memory circuit of the pixel 711. In FIGS. 3, 4 and 5, a represents a display timing while b represents a write timing of image data to the memory circuit disposed in the pixel.

Figure 3A:
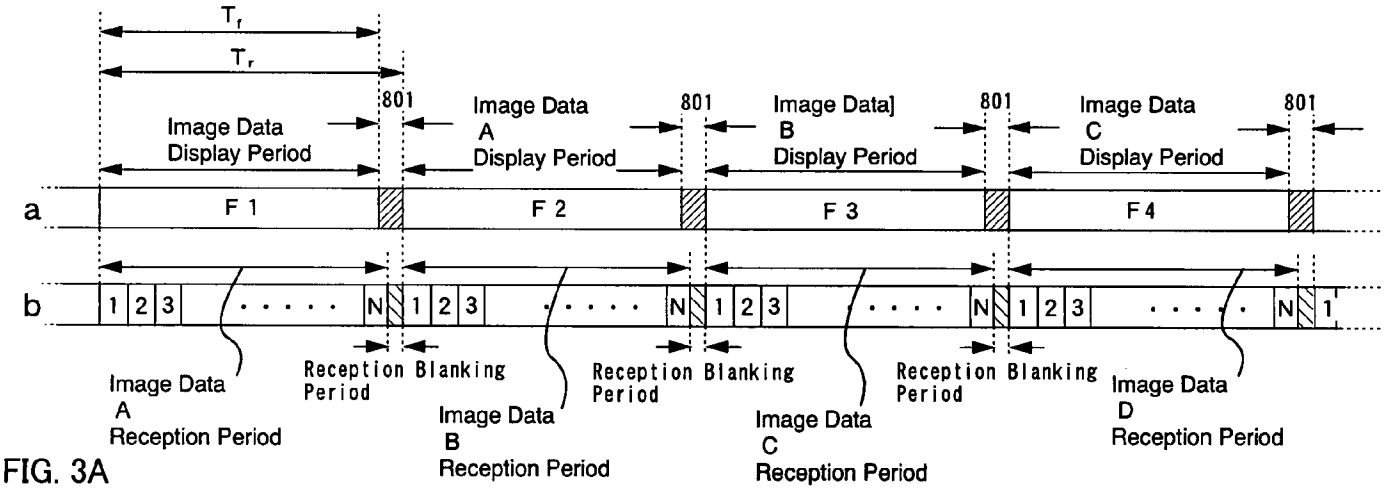
FIGS. 3A-3B are diagrams illustrating a synchronous method of reception and display of image data in accordance with the invention.

First, the synchronous method A is described in detail with reference to FIG. 3. FIG. 3A shows a case where n=1, which is described first herein. First, while image data stored in a display memory circuit disposed in the pixel is displayed in a frame period F1, the image data A is written into a write memory circuit disposed in the pixel. While the image data is displayed, the display control circuit 707 in FIG. 1 outputs a signal to inform that the display has not yet terminated to the write control circuit 718 through the synchronous signal 723. In the middle of the reception period $T_r$, the write control circuit 718 outputs a signal to inform that the reception cycle has not yet terminated to the display control circuit 707 through the synchronous signal 723. Then, when image data display for one frame is completed, the display control circuit 718 informs that the image data display for one frame is over to the write control circuit 718 through the synchronous signal 723. At this point, the reception cycle $T_r$ has not terminated yet, therefore, the display control circuit 707 is in an intermission state (a display blanking period 801). When the reception cycle $T_r$ terminates, the write control circuit 718 informs that the reception cycle $T_r$ is over to the display control circuit 707 through the synchronous signal 723, and sets an address outputted from the address controller at the address of the pixel to be written first in the next frame through an address control signal. Once the display control circuit 707 recognizes that the reception cycle $T_r$ is over, it switches a write memory circuit to a read memory circuit among the memory circuits disposed in the pixel, and vice versa, switches a read memory circuit to a write memory circuit therein, through the display control bus 715. Then, a frame period F2 starts to display the image data A. At the same time, the image data B that is received to be displayed in the frame period F3 starts to be written into a memory circuit that has been switched to the write memory circuit in sequence under the control of the write control circuit 718 and the address controller 703. The aforementioned operations are repeated to display image data on the display device.

Figure 3B:
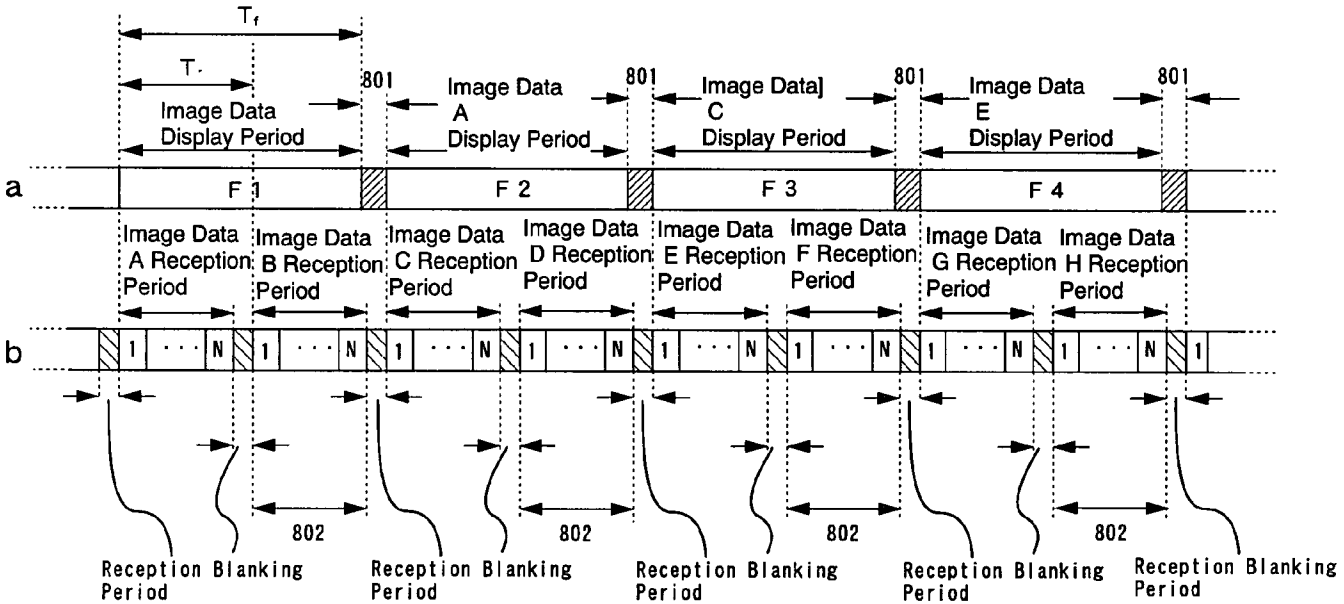

Now, a case where n=2 is described with reference to FIG. 3B. First, while image data stored in a display memory circuit disposed in the pixel is displayed in a frame period F1, the image data A is written into a write memory circuit disposed in the pixel. While the image data is displayed, the display control circuit 707 in FIG. 1 outputs a signal to inform that the display has not yet terminated to the write control circuit 718 through the synchronous signal 723. In the middle of the reception period, the write control circuit 718 outputs a signal to inform that the reception cycle has not yet terminated to the display control circuit 707 through the synchronous signal 723. Then, when the reception cycle terminates, the write control circuit 718 informs that the reception cycle is over to the display control circuit 707 through the synchronous signal 723. At this point, the frame period has not terminated yet, therefore, the write control circuit 718 sets an address outputted from the address controller at the address of the pixel to be written first in the next frame through an address control signal. Then, an intermission state (write blanking period 802) starts, and the image data B that is inputted next is not written into the memory circuit in the pixel, but discarded (corresponds to the write blanking period in FIG. 3B). Then, when the frame period F1 terminates, the display control circuit 707 informs that the frame period is over to the write control circuit 718 through the synchronous signal 723. The display control circuit 707 switches a write memory circuit to a read memory circuit among the memory circuits disposed in the pixel, and vice versa, switches a read memory circuit to a write memory circuit therein, through the display control bus 715. Then, a frame period F2 starts to display the image data A. At the same time, the image data B that is received to be displayed in the frame period F3 starts to be written into a memory circuit that has been switched to the write memory circuit in sequence under the control of the write control circuit and the address controller. The aforementioned operations are repeated to display image data on the display device.

Figure 4A:
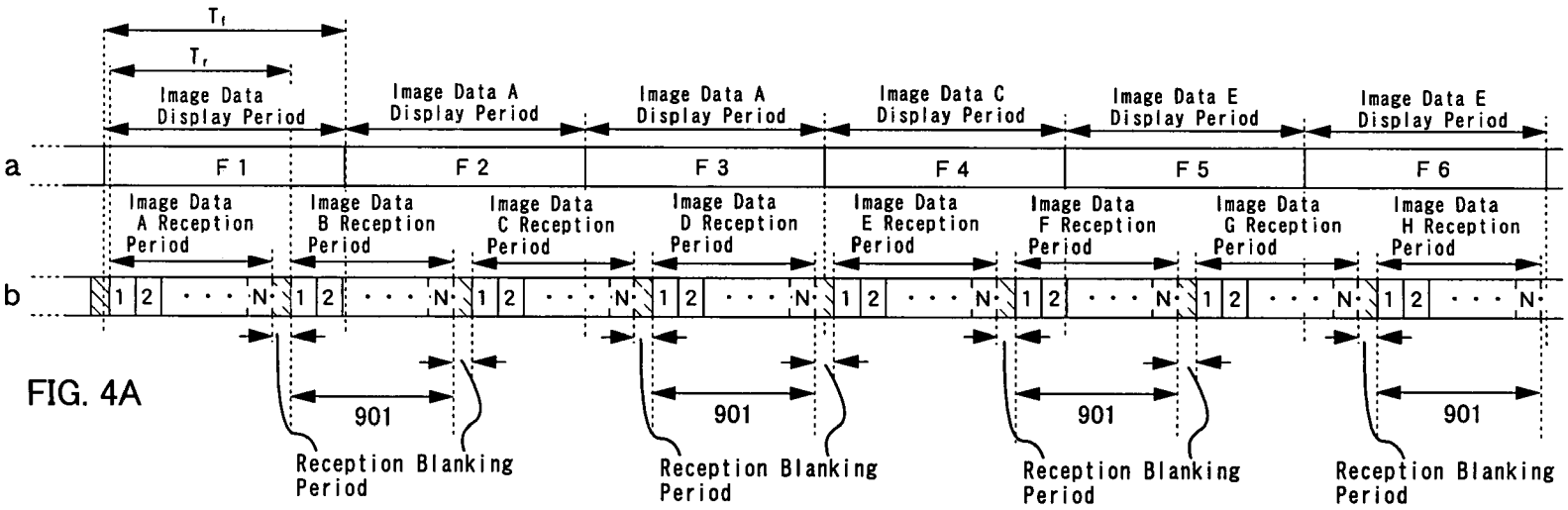
FIGS. 4A-4B are diagrams illustrating a synchronous method of reception and display of image data in accordance with the invention.

Now, description is made on the synchronous method B with reference to FIG. 4. First, a case where the reception period $T_r$ is shorter that the frame period $T_f$ is described with reference to FIG. 4A. While image data stored in a display memory circuit disposed in the pixel is displayed in the frame period F1, the image data A is written into a write memory circuit disposed in the pixel. While the image data is displayed, the display control circuit 707 in FIG. 1 outputs a signal to inform that the frame period F1 has not yet terminated to the write control circuit 718 through the synchronous signal 723. In the mid-reception cycle also, the write control circuit 718 outputs a signal to inform that the image data write period has not yet terminated to the display control circuit 707 through the synchronous signal 723. Then, when the reception cycle terminates, the write control circuit 718 informs that the reception cycle is over to the display control circuit 707 through the synchronous signal 723. At this point, the frame period has not terminated yet, therefore, the write control circuit 718 sets an address outputted from the address controller at an address of the pixel to be written first in the next reception cycle through an address control signal. Then, an intermission state (write blanking period 901) starts, and the image data B that is inputted next is not written into the memory circuit in the pixel, but discarded (corresponds to an image data B reception period, image data D reception period, image data F reception period and image data H reception period in FIG. 4A). In addition, the write control circuit 718 informs that it is in the write blanking period to the display control circuit through the synchronous signal. However, not only in the case of FIG. 4A, but also in the case where the write blanking period starts after the termination of the writing to the memory circuit in the pixel in a certain frame period, the write blanking period continues until the frame period terminates, even when a plurality of reception periods is provided in between. Then, when the frame period F1 terminates, the display control circuit 707 informs that the reception period is over to the write control circuit 718 through the synchronous signal 723. Once the display control circuit 707 recognizes that the write control circuit 718 immediately after the frame period F1 is in an intermission state (write blanking period), it switches a write memory circuit to a read memory circuit among the memory circuits disposed in the pixel, and vice versa, switches a read memory circuit to a write memory circuit therein, through the display control bus 715. Then, a frame period F2 starts to display the image data A. Next, when the write control circuit 718 enters a reception cycle for receiving image data C, it releases the write blanking period, and starts to write the image data C to a memory circuit that has been switched to the write memory circuit. At the same time, the write control circuit 718 informs that it is in an image data write period to the display control circuit 707. When the frame period F2 terminates, the display control circuit 707 informs that the reception period is over to the write control circuit 718 through the synchronous signal 723. Once the display control circuit 707 recognizes that the write control circuit 718 immediately after the frame period F2 is in an image data write period, it does not switch the read memory circuit in the pixel to the write memory circuit nor switches the write memory circuit therein to the read memory circuit, but instead, it displays the content of the memory circuit in the pixel that has been displayed in the frame period F2 again in the frame period F3. Then, when the reception of the image data C is over, the write control circuit 718 is in an intermission state (write blanking period) and informs that it is in the intermission state (write blanking period) to the display control circuit 707 through a synchronous signal. The aforementioned operations are repeated to display image data on the display device.

Figure 4B:
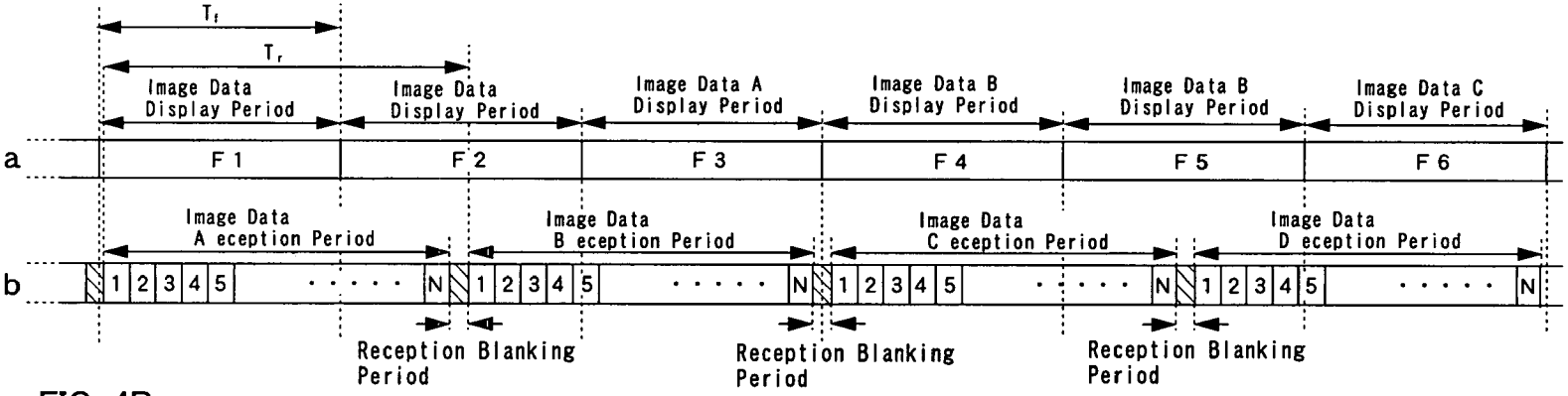

FIG. 4B shows a synchronous timing of reception and display in the case where the reception cycle $T_r$ is longer than the frame period $T_f$. Operation of the display device control circuit is similar to the one shown in FIG. 6A.

Figure 5A:
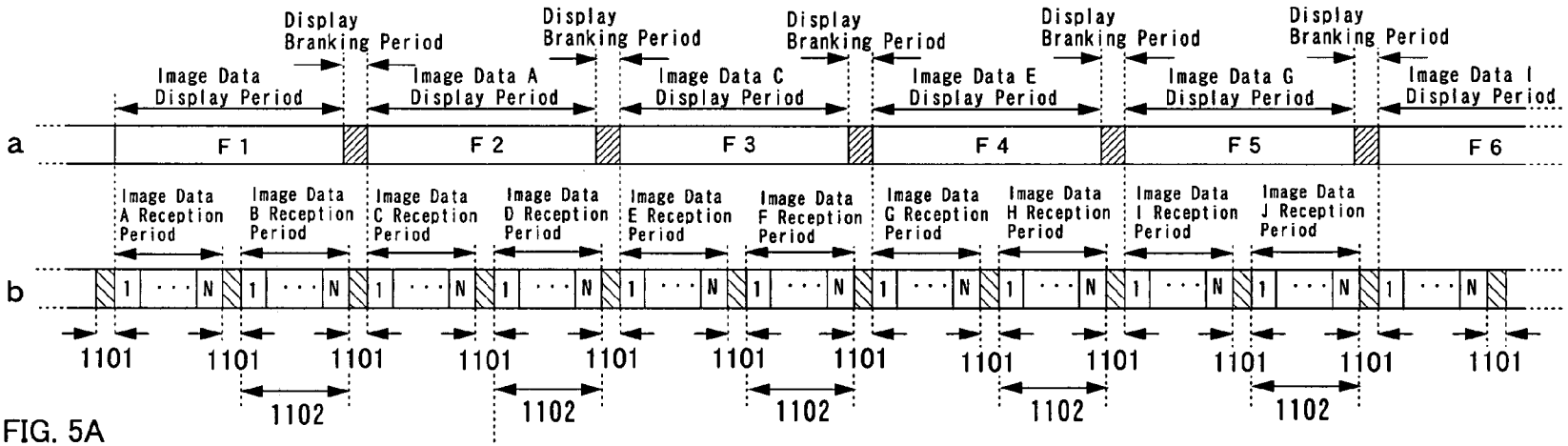
FIGS. 5A-5B are diagrams illustrating a synchronous method of reception and display of image data in accordance with the invention.
Figure 5B:
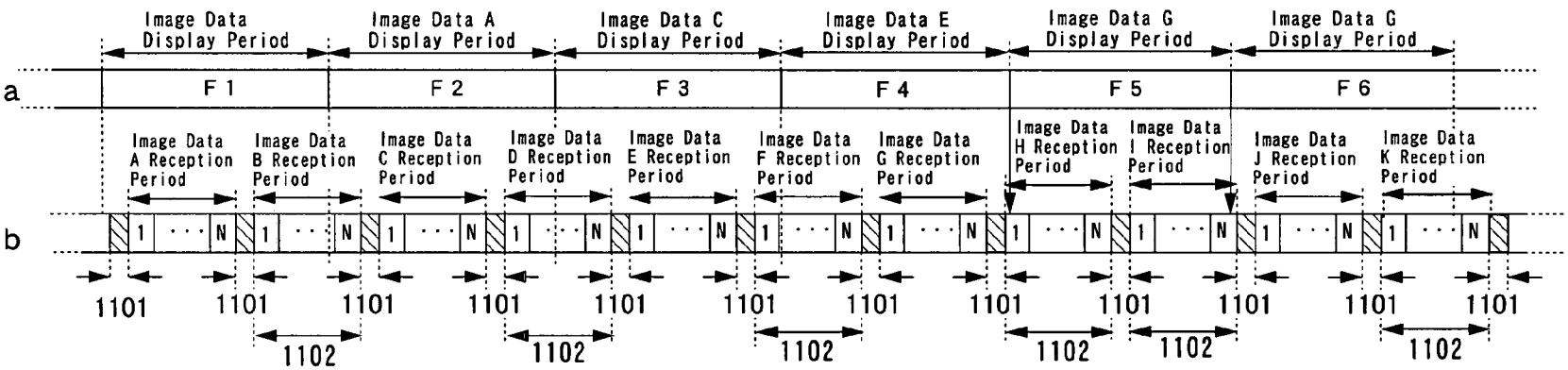

Now, the advantage of the use of the synchronous method A in the case where t(n) is sufficiently small is described with reference to FIG. 5. FIG. 5 shows a case where n of t(n) is 2. FIG. 5A shows a timing of reception and display in the case of using the synchronous method A while FIG. 5B shows a timing of reception and display in the case of using the synchronous method B. It is assumed here that a frame period, a reception cycle and a reception blanking period 1101 are all equal in length in FIG. 5A and FIG. 5B. In the case of using the synchronous method A in FIG. 5A, an image data write period and a write blanking period 1102 are alternately repeated in each cycle, and image data is updated to the new one every frame. On the other hand, in the case of using the synchronous method B in FIG. 5B, such periods as an image data B reception period, an image data D reception period, an image data F reception period, an image data H reception period, an image data I reception period and an image data K reception period all correspond to the write blanking periods 1102. However, the transition point from the frame period F5 to the frame period F6 is not in the write blanking period but in the period in which the image data I is written into a memory circuit in the pixel. Therefore, The same image data G as in F5 is displayed in F6. In this manner, in the case where the same data as that of the previous frame is displayed frequently, after-images are more easily recognized in the case of displaying high-speed moving images for example.

EMBODIMENT 1

Figure 6:
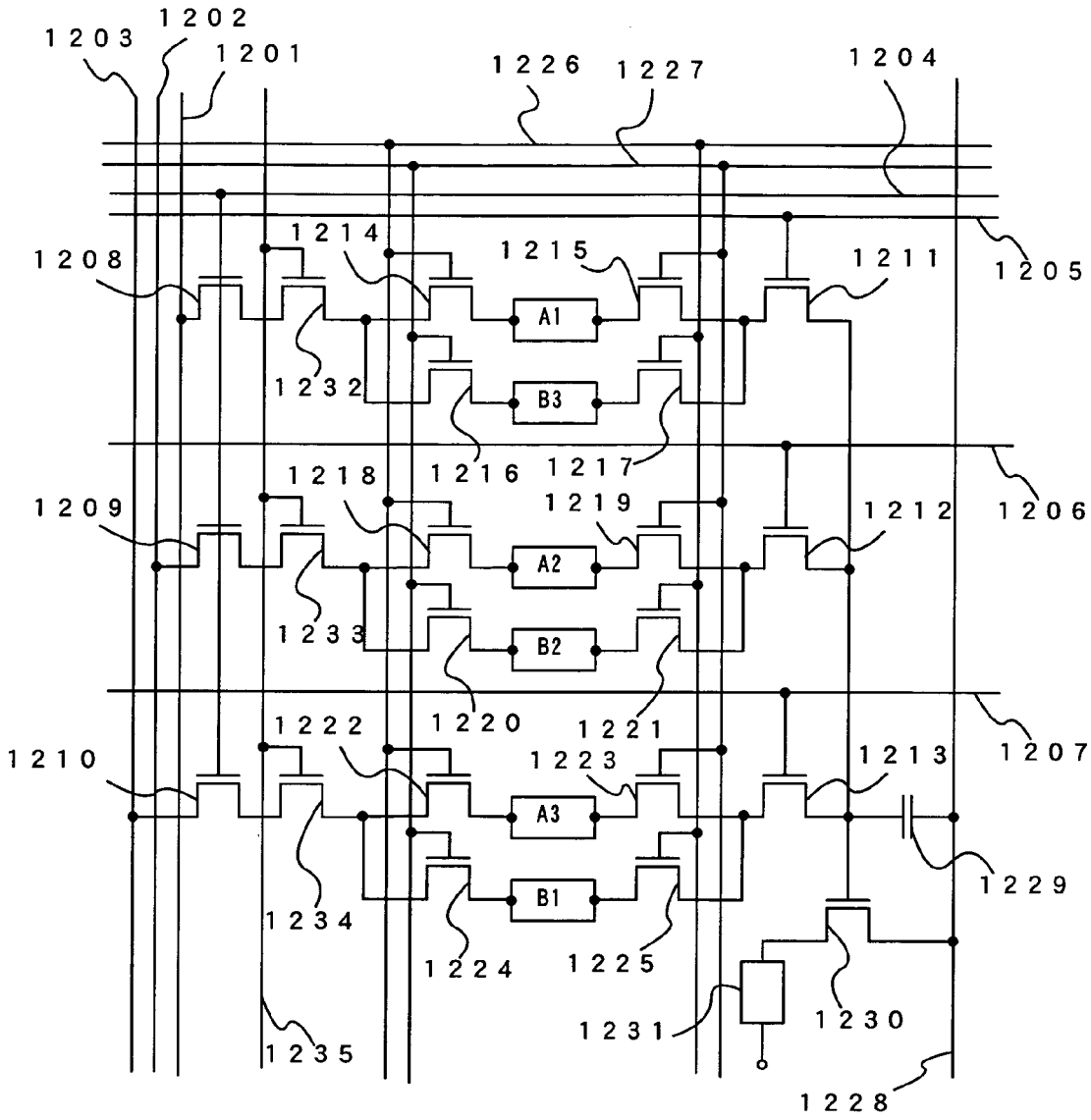
FIG. 6 is a detailed diagram illustrating pixels each including a plurality of memory circuits therein.

In this embodiment, a part of a pixel portion used in the display device of the invention is described with reference to FIG. 6. FIG. 6 is a detailed diagram illustrating the circuit configuration of the pixel 711 in FIG. 1. This pixel corresponds to a 3-bit digital gray scale. Reference numeral 1229 represents a capacitor (Cs), 1230 represents an EL driving TFT, 1231 represents an EL element, 1228 represents a current supply line, 1201, 1202 and 1203 each represent source signal lines, 1204 represents a row selection signal line, 1235 represents a column selection signal line, 1205 to 1207 each represent display control signal lines, 1208 to 1210 and 1232 to 1234 each represent write TFTs, 1211 to 1213 each represent read TFTs. A memory circuit selection portion includes write selection TFTs 1214, 1216, 1218, 1220, 1222, 1224, read selection TFTs 1215, 1217, 1219, 1221, 1223, 1225 and the like. Reference numerals 1226 and 1227 each represent memory circuit selection signal lines.

Note that the source signal lines 1201 to 1203 are identical to the image data bus 701 in FIG. 1, the display control signal lines 1205 to 1207 and the memory circuit selection signal lines 1226 and 1227 are identical to the display control signal bus 715 in FIG. 1. In addition, the row selection signal line 1204 is identical to the row selection signal line 714 in FIG. 1, and the row selection signal line 1235 is identical to the column selection signal line 713 in FIG. 1.

Figure 7B:
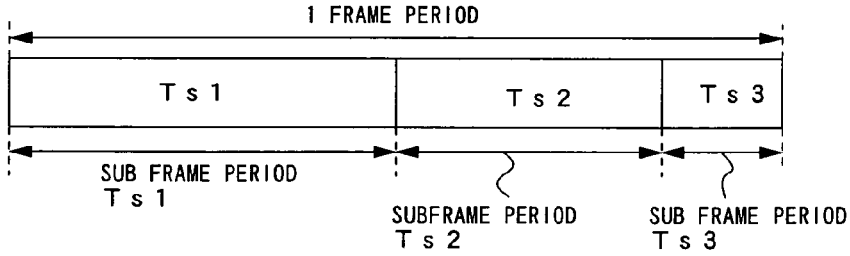

The operation of memory circuits A1 to A3 in FIG. 6 is shown by the behavior of a memory circuit A in FIG. 7A while the operation of memory circuits B1 to B3 is shown by the behavior of a memory circuit B in FIG. 7A. In a frame period A in FIG. 7, the memory circuit selection signal line 1226 becomes "1" and the memory circuit selection signal line 1227 becomes "0", which causes the sources and drains of the write selection TFTs 1214, 1218 and 1222 to be conductive, the sources and drains of the write selection TFTs 1216, 1220 and 1224 to be non-conductive, the read selection TFTs 1217, 1221 and 1215 to be conductive, and the read selection TFTs 1215, 1219 and 1223 to be non-conductive. Accordingly, when the row selection signal line 1204 and the column selection signal line 1235 become "1", namely only when a pixel is selected by address decoding, the write TFTs 1208 to 1210 and 1232 to 1234 are turned ON, whereby image data propagated from the source signal lines 1201 to 1203 is written into the memory circuits A1 to A3. At the same time, by using a display method in which one frame period is divided into a plurality of sub-frames (time gray scale method) shown in FIG. 7B, a pulse is inputted to the display control signal line 1205 to turn ON the read TFT 1221 in Ts1. Then, the image data written in the memory circuit B1 is transferred to the gate of the EL driving TFT 1230, and current flows from the power supply line 1228 into the EL element 1231 when the image data has a potential of "1" assuming that the EL driving TFT 1230 is an N-channel TFT, thus the EL element 1231 emits light. In Ts2, a pulse is inputted to the display control signal line 1206 to turn ON the read TFT 1212, and the image data written in the memory circuit B2 is displayed. In Ts3, a pulse is inputted to the display control signal line 1207 to turn ON the write TFT 1213, and the image data written in the memory circuit B3 is displayed. That is, in the frame period A, the memory circuits A1 to A3 function as the write memory circuits while the memory circuits B1 to B3 function as the display memory circuits. Next, when the frame period B starts, the potentials of the memory circuit selection signal lines 1226 and 1227 are inverted, thereby switching A1 to A3 to the display memory circuits and B1 to B3 to the write memory circuits. When the image data in the previous frame period is to be displayed in the next frame period again, the potentials of the memory circuit selection signal lines 1226 and 1227 are required to be inverted as in the transition point from the frame period C to the frame period D in FIG. 7.

Each of the memory circuits A1 to A3 and B1 to B2 disposed in the pixels shown in this embodiment is a static memory (SRAM), however, the pixel portion may be configured with a ferroelectric memory (FeRAM) or a dynamic memory (DRAM). In addition, the TFTs in the pixels used in this embodiment are all N-channel TFTs, however, a part or all of the TFTs in the pixels may be P-channel TFTs. Further, the capacitor 1229 is not necessarily provided in this embodiment.

EMBODIMENT 2

Figure 8:
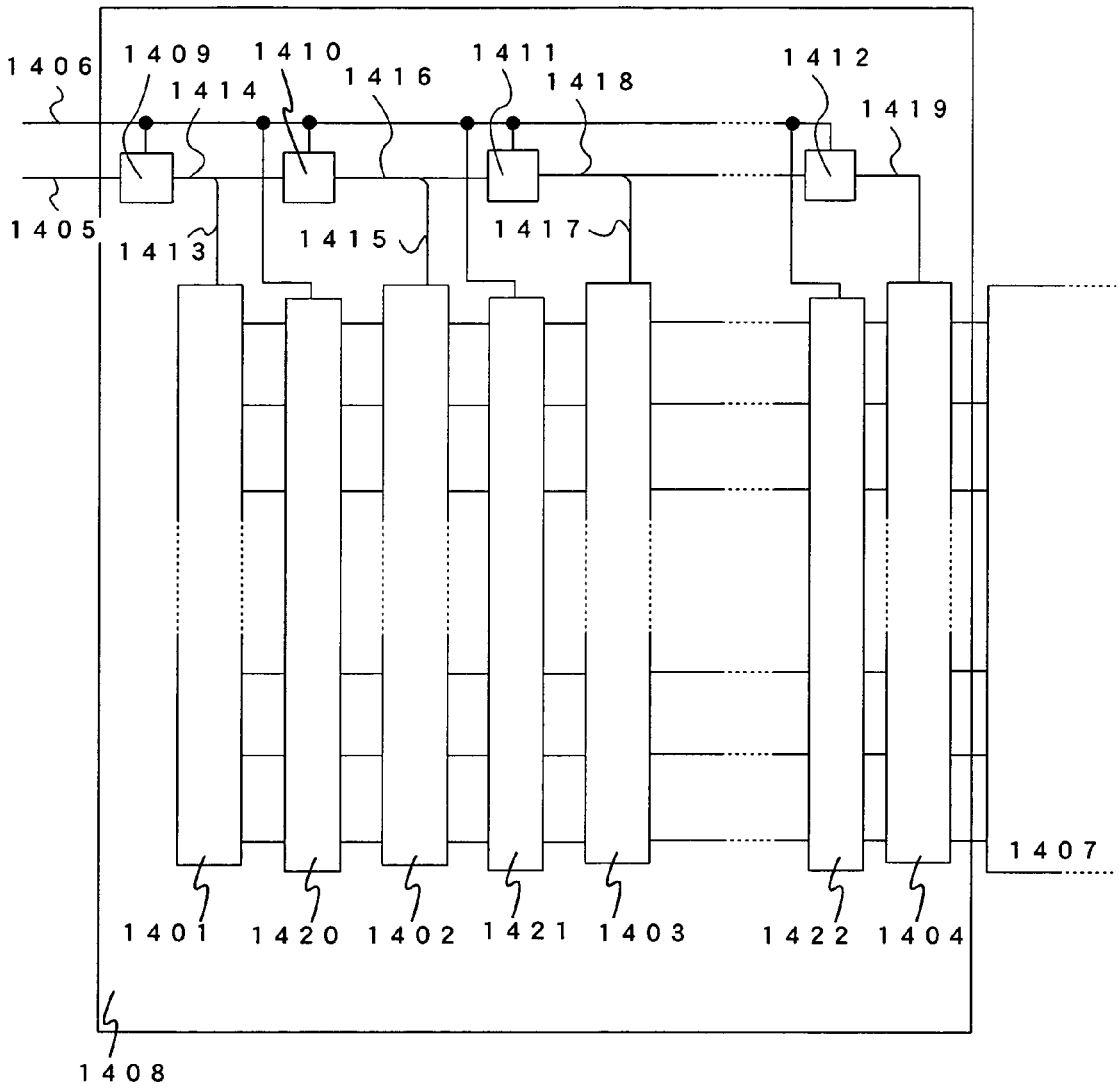
FIG. 8 is a diagram illustrating a circuit configuration of a decoder capable of decoding an address rapidly.

In this embodiment, a method for achieving a high-speed address decoding in the display device used in the invention is described. FIG. 8 illustrates a configuration of a row decoder or a column decoder disposed in the display device of the invention. Reference numeral 1408 represents a decoder shown in this embodiment. The decoder includes N address latch flip-flop circuits, and the k-th (k is a natural number and $0 \leqq k \leqq N+1$) address latch flip-flop circuit from the first address latch flip-flop circuit to be inputted with image data is referred to as the k-th address latch flip-flop circuit. In FIG. 8, the first address latch flip-flop circuit corresponds to 1409, the second address latch flip-flop circuit corresponds to 1410, the third address latch flip-flop circuit corresponds to 1411 and the N-th address latch flip-flop circuit corresponds to 1412. Although only four address latch flip-flop circuits are shown in the figure, N address latch flip-flop circuits are provided in practice. Each of the N address latch flip-flop circuits is inputted with a clock 1406. An address bus 1405 has a bit width of M bits (M is a natural number), and inputted to the first address latch flip-flop 1409, which outputs a first internal address bus 1414. The output of the k-th address latch flip-flop is assumed to be the k-th internal address bus, and when branching the k-th internal address bus into $m_k$ bits, a signal having the $m_k$-bit width that is branched out from the k-th internal address bus is referred to as an Mk-bit internal address bus. In addition, when k=N, all the bits of the N-th internal address bus are referred to as an $m_n$-bit internal address bus. Accordingly, it is referred to not as an $m_N$-bit internal address bus but as the N-th internal address bus. Among the above k-th internal address buses, those that do not correspond to the $m_k$-bit internal address bus are inputted to the (k+1)-th address latch flip-flop. Accordingly, the k-th internal address bus has a bit width represented by $M-(m_1+m_2+m_3+\ldots+m_{k-1})$ assuming that k is 2 or more. In addition, N decoders are provided inside of the decoder 1408, and the k-th decoder among the decoders is inputted with the $m_k$-bit internal address bus, which is referred to as an $m_k$-bit decoder. The $m_k$-bit decoder outputs $2^{m1}\times2^{m2}\times2^{m3}\times\ldots\times2^{mk}$ signals. In addition, the decoder includes N decode signal latch flip-flop circuits, and all the signals outputted from the $m_k$-bit decoder are inputted to the decode signal latch flip-flop circuit. The decode signal latch flip-flop circuit to be inputted with each signal outputted from the $m_k$-bit decoder is referred to as the k-th decode signal latch flip-flop circuit. The k-th decode signal latch flip-flop circuit outputs $2^{m1}\times2^{m2}\times2^{m3}\times\ldots\times2^{mk}$ signals to the $(m_{k+1})$-bit decoder. Each of the decode signal latch flip-flop circuits is inputted with the clock 1406. In FIG. 8, reference numeral 1401 represents an $m_1$-bit decoder, 1402 represents an $m_2$-bit decoder, 1403 represents an $m_3$-bit decoder, 1404 represents an $m_N$-bit decoder, 1420 represents the first decode signal latch flip-flop circuit, 1421 represents the second decode signal latch flip-flop circuit, 1422 represents the (N−1)-th decode signal latch flip-flop circuit, 1414 represents the first internal address bus, 1416 represents the second internal address bus, 1418 represents the third internal address bus, 1419 represents the N-th internal address bus, 1413 represents the $m_1$-bit internal address bus, 1415 represents the $m_2$-bit internal address bus, 1417 represents the $m_3$-bit address bus and 1407 represents a pixel portion. $2^{m1}\times2^{m2}\times2^{m3}\times\ldots\times2^{mN}$ signal lines, namely $2^M$ signal lines are inputted to the pixel portion 1407 from the $m_N$-bit decoder. The signal lines are similar to the column selection signal lines or row selection signal lines described in Embodiment 1 and embodiment mode.

Figure 9:
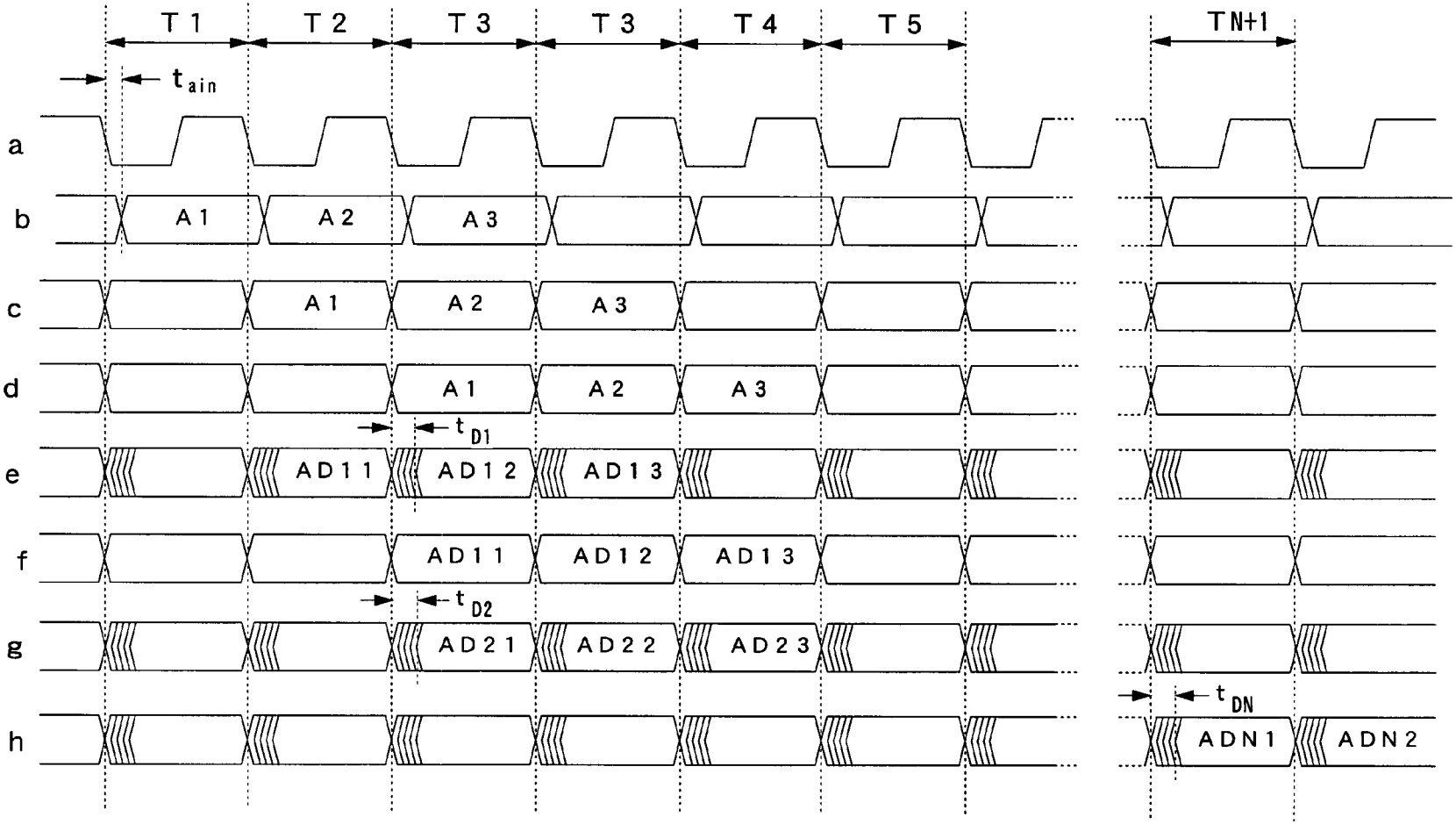
FIG. 9 is a timing chart illustrating an operation of a decoder capable of decoding an address rapidly.

The operation of the decoder shown in FIG. 8 is described with reference to FIG. 9. First, the operation of the address latch flip-flop circuit and the decode signal latch flip-flop circuit is described. The address latch flip-flop circuit and the decode signal latch flip-flop circuit are controlled by the clock 1406. The output potential of the address latch flip-flop circuit or the decode signal latch flip-flop circuit is held when the potential of the clock 1406 does not change, however, the output potential of the address latch flip-flop circuit or the decode signal latch flip-flop circuit is updated to an input potential when the potential of the clock 1406 changes from "0" to "1" (rising edge) or changes from "1" to "0" (falling edge). In this embodiment, description is made on the assumption that the output potential of the address latch flip-flop circuit or the decode signal latch flip-flop circuit is updated to an input potential when the potential of the clock 1406 changes from "1" to "0". However, it is also possible that the output potential of the address latch flip-flop circuit or the decode signal latch flip-flop circuit is updated to an input potential when the potential of the clock 1406 changes from "0" to "1". First, when an address is inputted in synchronization with a clock, a delay time $t_{ain}$ that is from the falling edge until the input of a new address corresponds to the one, in which a delay time that is from the output of an address from the address counter until the input thereof to the decoder is added to the $t_{acount}$ in FIG. 2 described in embodiment mode. When A1 is inputted to the first address latch flip-flop circuit from the address bus at the beginning of T1, the potential of the first internal address bus is updated to A1 at the next falling edge of the clock (transition point from T1 to T2). At the same time, the potential A2 is inputted to the address bus. At this point, $m_1$ bits of A1 is branched into an $m_1$-bit address bus, and the $m_1$-bit address is decoded by the $m_1$-bit decoder, causing the output potential of the $m_1$-bit decoder to be AD11, which is then inputted to the first decode signal latch flip-flop circuit. Assuming that the time required for decoding by the first decode signal latch flip-flop circuit is $t_{D1}$, the $t_{D1}$ has to be within a clock cycle. At the next falling edge of the clock (transition point from T2 to T3), data A12 that is the potential A1 of the first internal address bus after subtracted by $m_1$ bits by branch is outputted from the second address latch flip-flop circuit to the second internal address bus. Then, among the second internal address busses, the $m_2$-bit address is branched out to be inputted to the $m_2$-bit decoder. At the same time, the output potential of the first decode signal latch flip-flop circuit is updated to AD11, and the updated output of the first decode signal latch flip-flop circuit is inputted to the $m_2$-bit decoder. Then, it is decoded in accordance with the $m_2$-bit address inputted to the $m_2$-bit decoder, and the $m_2$-bit decoder inputs a potential AD22 resulting from the decoding to the second decode signal latch flip-flop circuit. At this time, the time required for decoding by the $m_2$-bit decoder is assumed to be $t_{D2}$. At the same time, an address A3 is inputted to the address bus. Through the repetition of the aforementioned operations, a potential ADN1 resulting from the decoding of all the bits of the address A1 in TN+1 is outputted from the N-th decode signal latch flip-flop circuit to the pixel portion. In general, assuming that the time required for the $m_k$-bit decoder to decode input data is $t_{DK}$, the $t_{DK}$ may be within a clock cycle. In the case where the decoding is performed without the use of this embodiment, the decode time is substantially as long as the sum of the k when $t_{ac}$ is $t_{DK}$, namely $t_{D1}+t_{D2}+\ldots+T_{DN}$, according to the write timing to the memory circuit in the pixel described in embodiment with reference to FIG. 2, which puts more restrictions on the time for performing writing to the memory circuit in the pixel than the case of employing this embodiment, and it will be of a particular significance when the pixel portion is enlarged.

In this embodiment, the output potential of the address latch flip-flop circuit or the decode signal latch flip-flop circuit is held when the potential of the clock 1406 is "1", however, the output potential of the address latch flip-flop circuit or the decode signal latch flip-flop circuit may be updated to an input potential when the potential of the clock signal is "0". Similarly, the output potential of the address latch flip-flop circuit or the decode signal latch flip-flop circuit is held when the potential of the clock 1406 is "0", however, the output potential of the address latch flip-flop circuit or the decode signal latch flip-flop circuit may be updated to an input potential when the potential of the clock 1406 is "1". In addition, it is also possible to configure the circuit so that the output potential of an even-number-th address latch flip-flop circuit and an odd-number-th decode signal latch flip-flop circuit is each updated to an input potential with the clock 1406 at a potential of "0" while the output potential of the odd-number-th address latch flip-flop circuit and the even-number-th decode signal latch flip-flop circuit is each updated to an input potential with the clock 1406 at a potential of "1". Alternatively, it is possible to configure the circuit so that the output potential of the even-number-th address latch flip-flop circuit and the odd-number-th decode signal latch flip-flop circuit is each updated to an input potential with the clock 1406 at a potential of "1" while the output potential of the odd-number-th address latch flip-flop circuit and the even-number-th decode signal latch flip-flop circuit is each updated to an input potential with the clock 1406 at a potential of "0". In this case, tDk is required to be half as long as the clock cycle or shorter. Alternatively, the output of the $m_N$-bit decoder may be provided with a decode signal latch flip-flop circuit. Further, if there is no need, the decoding is not required to be performed by dividing addresses in accordance with the aforementioned method. This embodiment can be implemented in combination with Embodiment 1.

EMBODIMENT 3

Figure 10:
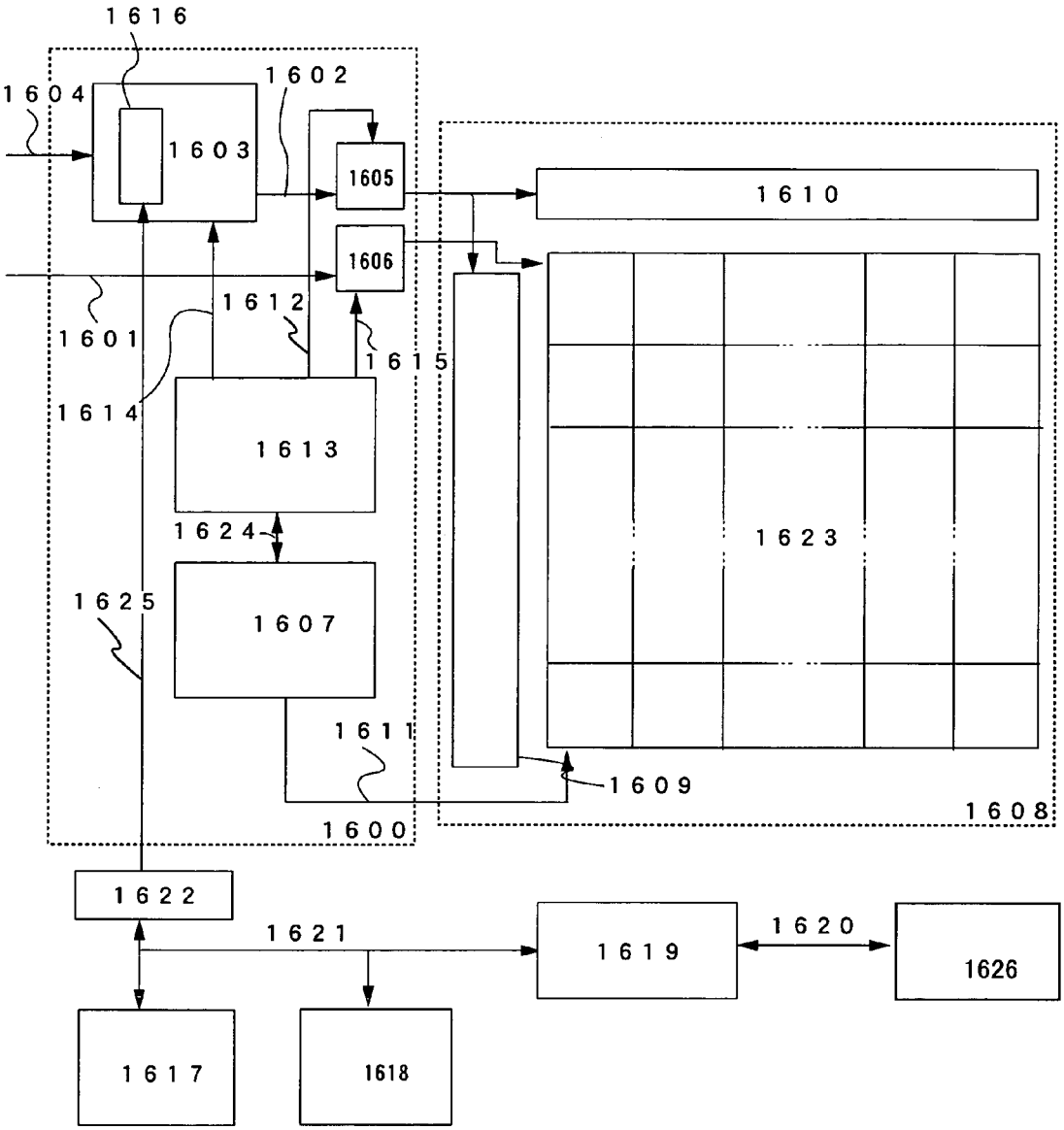
FIG. 10 is a diagram illustrating a circuit configuration of a circuit for performing image processing in accordance with the invention.

In this embodiment, description is made on a method where the whole screen of a display device is divided into several sections, whereby updating of the received image data is carried out only in the required sections, and the address counting method by the address controller is controlled to perform image processing such as magnification, shrink, rotation and inversion. FIG. 10 illustrates this embodiment. A display device control circuit 1600 includes an image data bus 1601, an address bus 1602, an address controller 1603, a synchronous clock 1604, an address latch circuit 1605, an image data latch circuit 1606, a display control circuit 1607, a display control bus 1611, an address write control signal 1612, a write control circuit 1613, an address control signal 1614, an image data write control signal 1615, a synchronous signal 1624, an image processing control register 1616 and an image processing control signal 1625. A display device 1608 includes a row decoder 1609, a column decoder 1610 and a pixel portion 1623. The reference numerals 1600 to 1615, the synchronous signal 1624 and the pixel portion 1623 are similar to those shown in FIG. 1 in embodiment mode. In addition, a display device interface 1622 is provided outside of the display device and the display device control circuit. Data is transferred between a CPU 1617, a memory 1618, an I/O interface 1619 and the display device interface 1622 through a host bus 1621. In the electric circuit shown in FIG. 10, data is transferred between the I/O interface and an external peripheral device 1626 through an I/O bus 1620.

Method for controlling the display device by the circuit shown in FIG. 10 is described now. First, the whole pixels are divided into several sections, each of which is assigned an address. The image processing control register 1616 specifies an address of the pixel section to be updated from the external device through the CPU 1617, the memory 1618 or the I/O bus 1620. Note that a plurality of the pixel sections among the pixel sections may be coupled, or separate pixel sections can be specified. The address controller 1603 can automatically change the counting method of addresses in writing the received image data in accordance with the size of the pixel section, for example such that in the case where the number of the pixels in a pixel section is half as many as the whole pixels, one address is added each time image data for two pixels is received. At this time, when the data for the two pixels is received, the display control circuit 1607 performs control so that unnecessary image data for one pixel is not allowed to be written into the memory circuit in the pixel. When an image that is displayed across one or a plurality of pixel sections is to be still, information to allow the image to be still, and information on the address of one or a plurality of the pixel sections is held in the image processing register, whereby image data is not written to one or a plurality of the pixel sections. In addition, when an image displayed across one or a plurality of pixel sections is to be applied image processing such as magnification, shrink, inversion and rotation, the image processing such as magnification, shrink, inversion and rotation can be performed by storing information on the image processing such as magnification, shrink, inversion and rotation and information on the address of one or a plurality of the pixel sections in the image processing register through the image processing control signal 1600 and changing the counting method of the specified address of one or a plurality of the pixel sections. In this manner, image data is required to be transferred only to the necessary pixel sections of the display device, which contributes to power saving. This embodiment can be implemented in combination with Embodiment 1 and Embodiment 2.

EMBODIMENT 4

Electronic apparatuses according to the invention include a video camera, a digital camera, a goggle type display (head mounted display), a navigation system, a sound reproducing device (car audio set and component stereo set, etc.), a notebook type personal computer, a game machine, a portable information terminal (mobile computer, mobile phone, mobile game machine and electronic book, etc.), an image reproducing device provided with a recording medium (specifically, a device reproducing a recording medium such as a Digital Versatile Disc (DVD) and having a display for displaying the reproduced image), and the like. Specific examples of these electronic apparatuses are shown in FIG. 11.

Figure 11A:
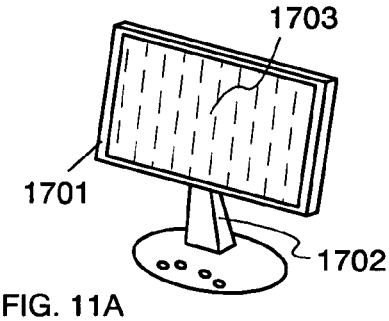
FIGS. 11A-11G are views of electronic apparatuses each employing a display device and a control circuit thereof in accordance with the invention.

FIG. 11A illustrates a display device including a housing 1701, a supporting base 1702 and a display portion 1703. The invention can be applied to the display device having the display portion 1703.

Figure 11B:
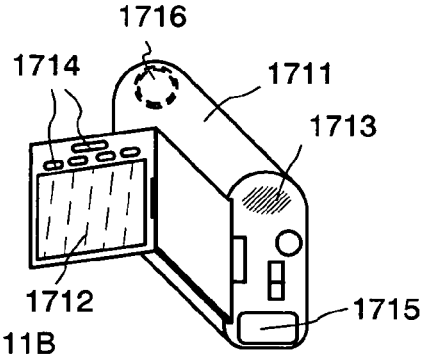

FIG. 11B illustrates a video camera including a main body 1711, a display portion 1712, an audio input 1713, operating switches 1714, a battery 1715, a receiving portion 1716 and the like. The invention can be applied to the display device having the display portion 1712.

Figure 11C:
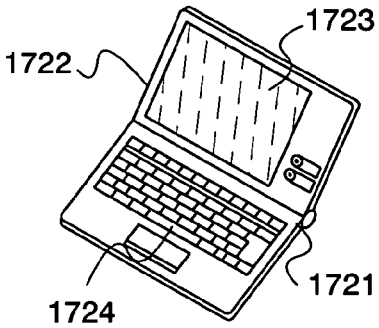

FIG. 11C illustrates a notebook type personal computer including a main body 1721, a housing 1722, a display portion 1723, a keyboard 1724 and the like. The invention can be applied to the display device having the display portion 1723.

Figure 11D:
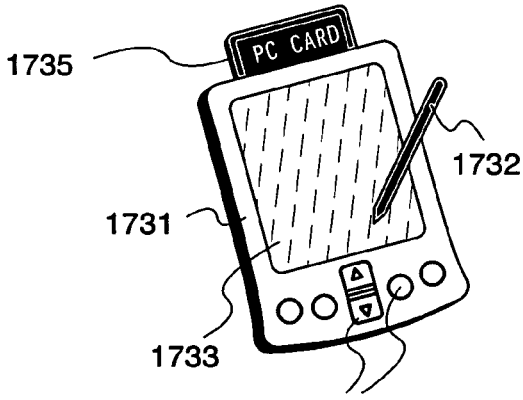

FIG. 11D illustrates a portable information terminal including a main body 1731, a stylus 1732, a display portion 1733, operating buttons 1734, an external interface 1735 and the like. The invention can be applied to the display device having the display portion 1733.

Figure 11E:
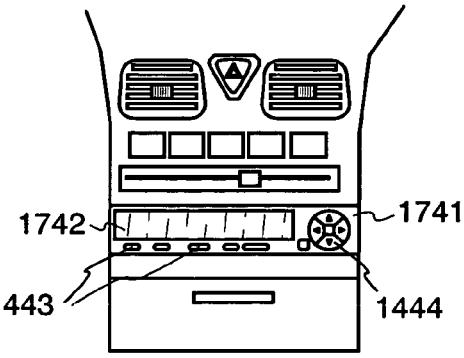

FIG. 11E illustrates a sound reproducing device, specifically a car audio set including a main body 1741, a display portion 1742, operating switches 1743 and 1744 and the like. The invention can be applied to the display device having the display portion 1742. Although a car audio set is taken as an example herein, the invention can be applied to a mobile or home audio set.

Figure 11F:
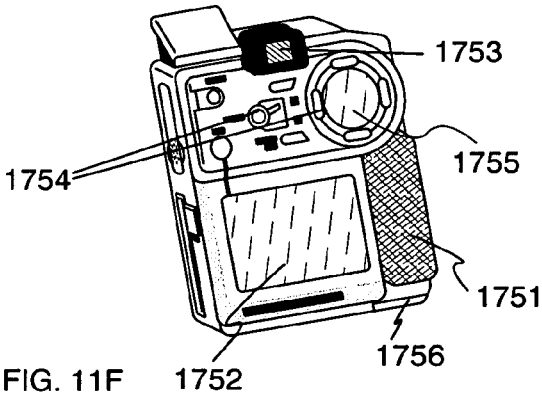

FIG. 11F illustrates a digital camera including a main body 1751, a display portion A 1752, an eye piece portion 1753, an operating switch 1754, a display portion B 1755, a battery 1756 and the like. The invention can be applied to the display device having the display portions A 1752 and B 1755.

Figure 11G:
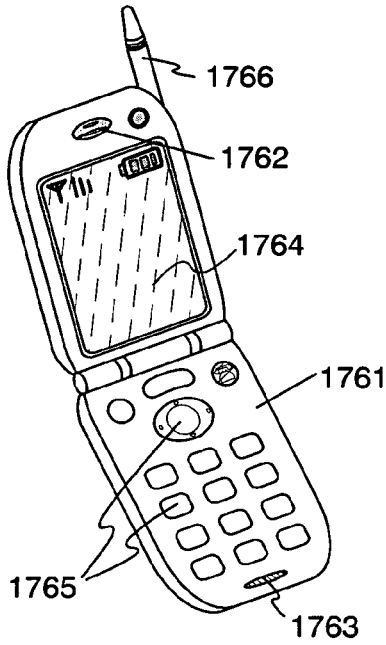
Figure 12:
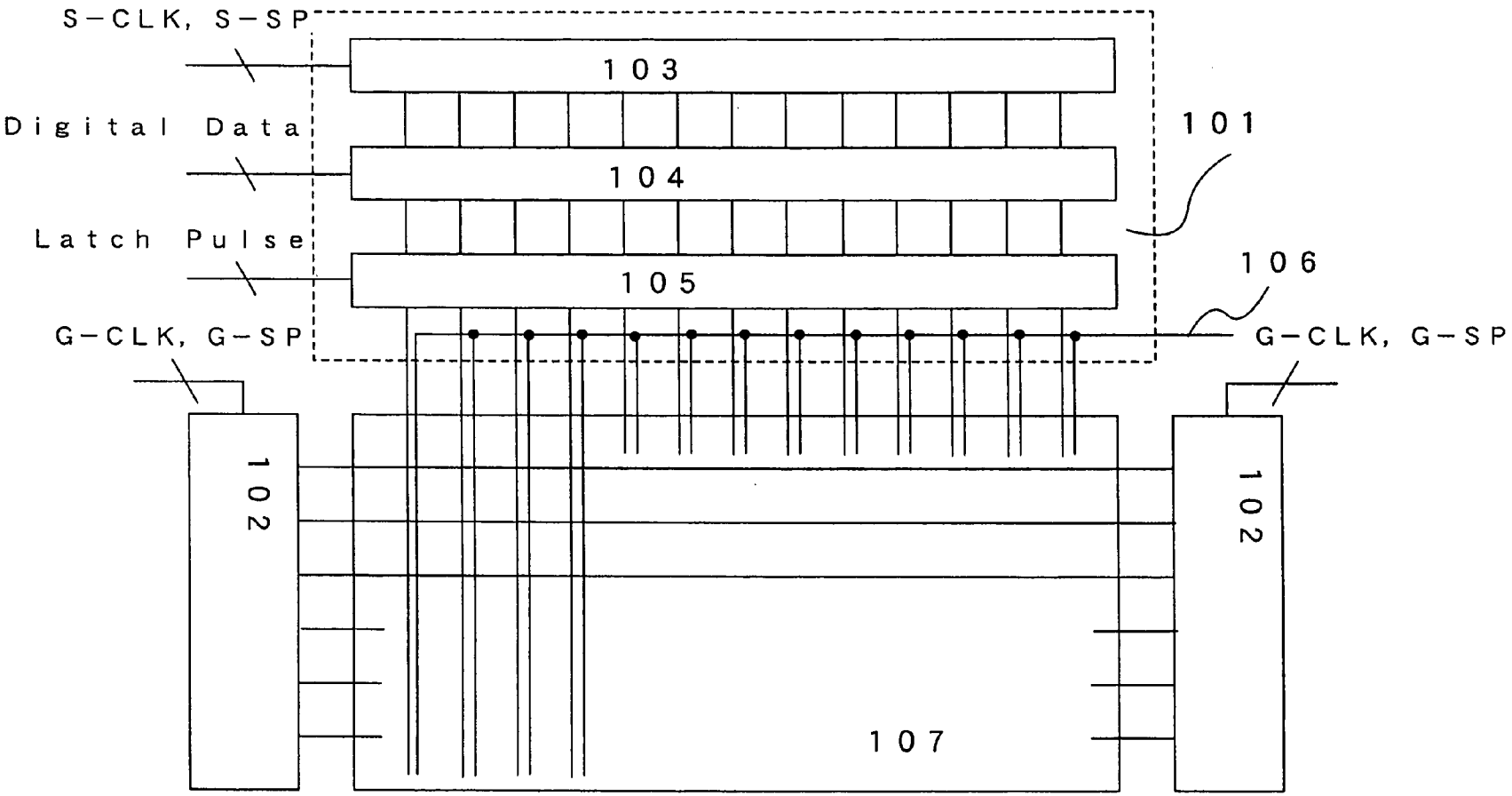
FIG. 12 PRIOR ART
FIG. 12 is a schematic diagram illustrating an overall circuit configuration of a conventional display device.
Figure 13:
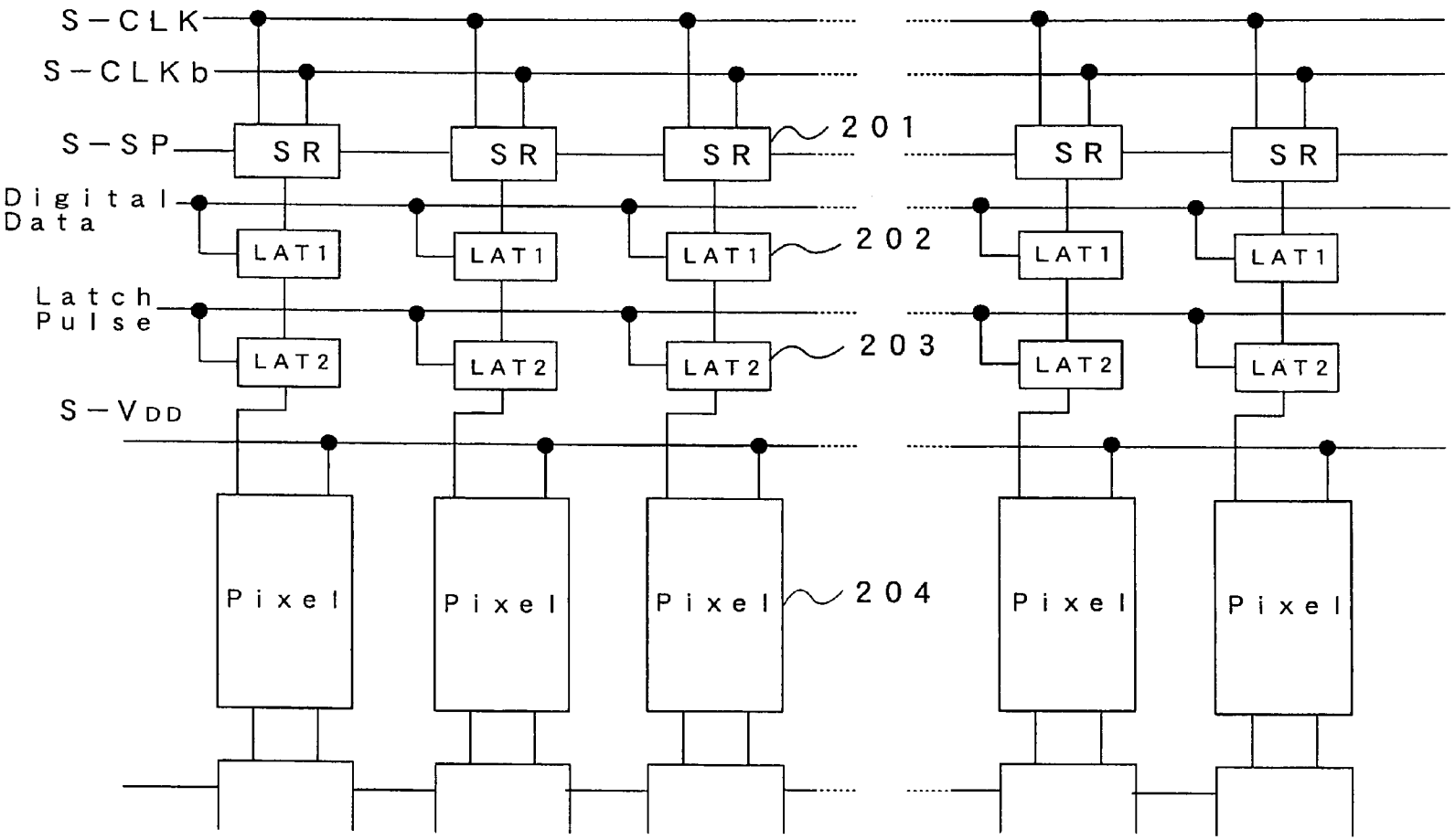
FIG. 13 PRIOR ART
FIG. 13 is a diagram illustrating a circuit configuration of a source signal line driving circuit of a conventional display device.
Figure 14A:
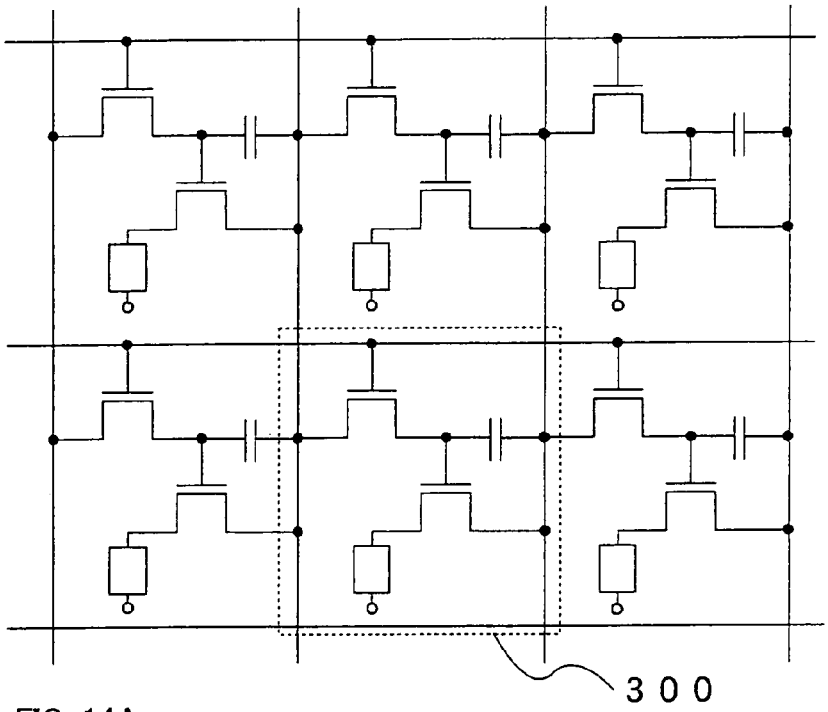
FIGS. 14A-14B are enlarged views of a pixel portion of a conventional display device.
Figure 14B:
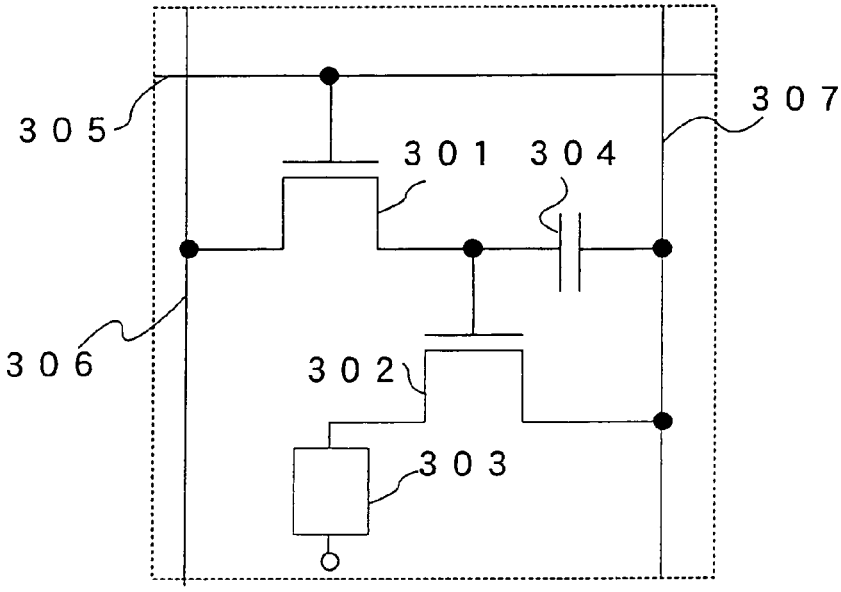
FIG. 14B PRIOR ART
Figures 15A, 15B, 15C:
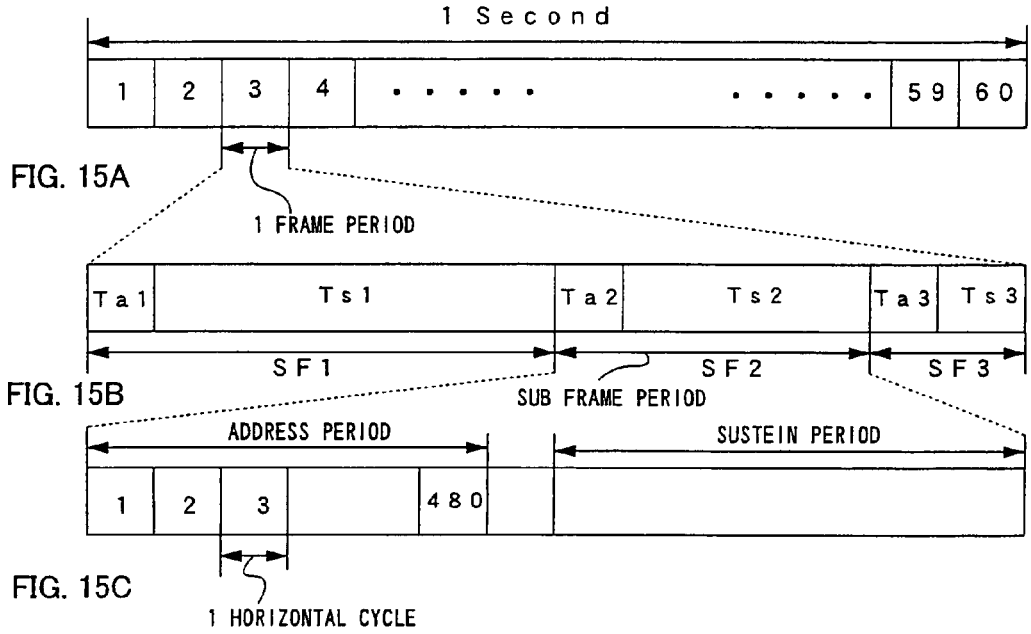
FIG. 15C PRIOR ART
FIGS. 15A-15C are diagrams illustrating a timing of a time gray scale method in a display device.
Figure 16:
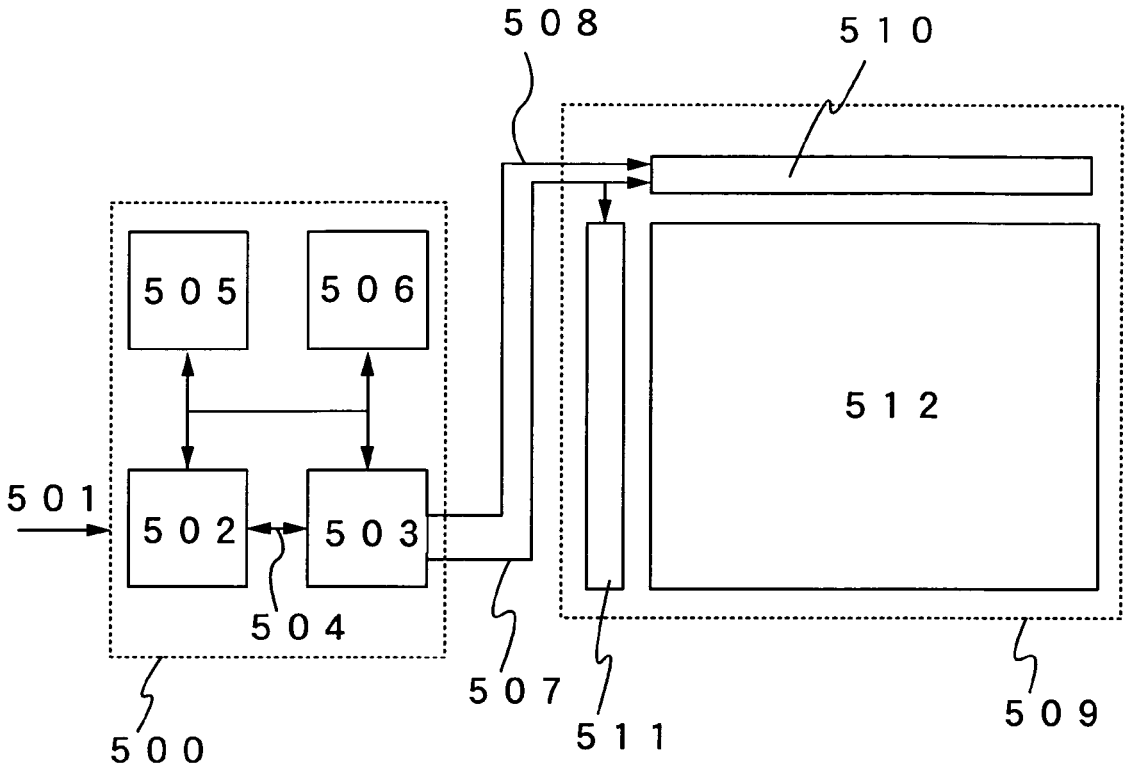
FIG. 16 is a diagram illustrating a configuration of a control circuit of a display device using a conventional time gray scale method.
Figure 17A:
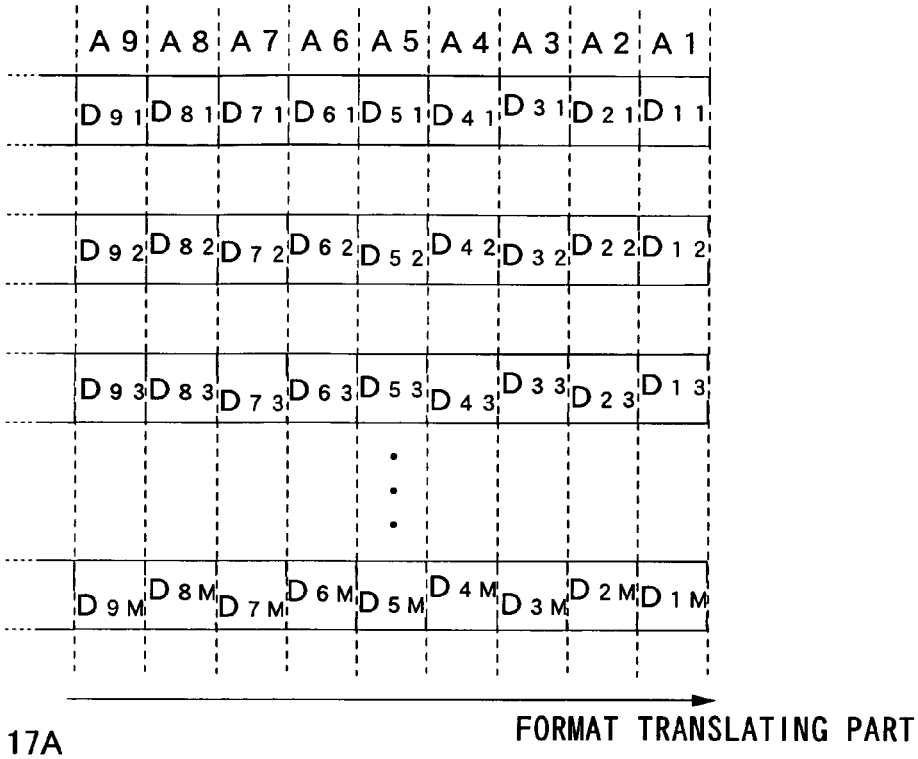
FIGS. 17A-17B are diagrams illustrating a format of received image data and a format of image data to be inputted to a display device using a time gray scale method.
Figure 17B:
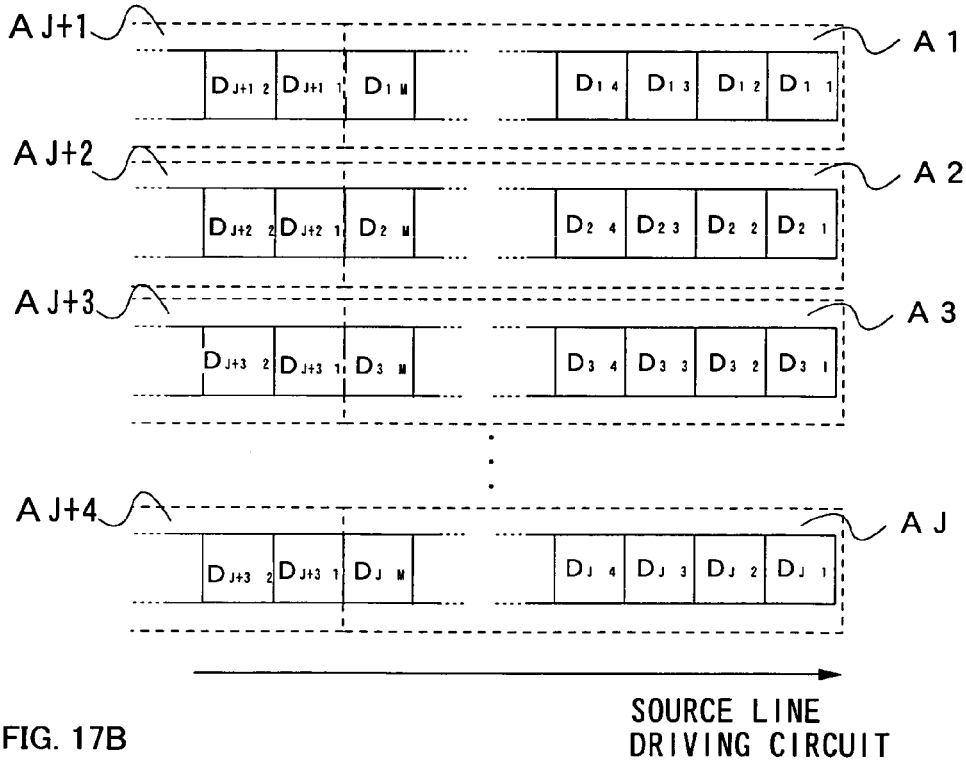

FIG. 11G illustrates a mobile phone including a main body 1761, an audio output portion 1762, an audio input portion 1763, a display portion 1764, operating switches 1765, an antenna 1766 and the like. The invention can be applied to the display device having the display portion 1764.

The display device used in the aforementioned electronic apparatuses can employ a heat-resistant plastic substrate as well as a glass substrate. Accordingly, further weight saving can be achieved.

Note that described in this embodiment are only examples, therefore, the invention is not limited to them.

This embodiment can be implemented in combination with any of embodiment mode and Embodiments 1 to 3.

What is claimed is:

1. A display device comprising:

a plurality of pixels;

a decoder for selecting one or more of memory circuits in each of the plurality of pixels, wherein the decoder is electrically connected to the plurality of the pixels;

an address latch circuit for holding a potential of an address data or updating the potential of an address data, wherein the address latch circuit is electrically connected to the decoder;

an address controller for being input a synchronous signal, and outputting an address data, wherein the address controller is electrically connected to the address latch circuit;

an image data latch circuit for holding a potential of an image data or updating a potential of an image data, wherein the image data latch circuit is electrically connected to the plurality of the pixels;

a write control circuit for outputting write control signals of an address data and an image data, wherein the write control circuit is electrically connected to the image data latch circuit, the address latch circuit and the address controller; and a display control circuit for inputting a display control signal to the respective pixels, wherein the display control circuit is electrically connected to the plurality of the pixels and the write control circuit.

2. The display device according to claim 1, wherein each of the plurality of the pixels includes:

a light emitting element;

a first switch electrically connected to the light emitting element;

a plurality of memory circuits electrically connected to the first switch;

a second switch electrically connected to the plurality of the memory circuits; and a signal line electrically connected to the second switch and the decoder.

3. The display device according to claim 2, wherein each of the plurality of the memory circuits includes a display memory circuit and a write memory circuit.

4. The display device according to claim 1, further comprising:

a display interface electrically connected to an image processing control register included in the address controller; and a CPU electrically connected to the display interface.

5. An electronic apparatus comprising the display device according to claim 1, wherein the electronic apparatus is one selected from the group consisting of a video camera, a notebook type personal computer, a portable information terminal, a sound reproducing device, a digital camera, and a mobile phone.

6. A display device comprising:

a plurality of pixels, each of which includes a plurality of memory circuits;

a decoder for selecting one or more of the memory circuits in each of the plurality of pixels, wherein the decoder is electrically connected to the plurality of the pixels;

an address latch circuit for holding a potential of an address data or updating the potential of an address data, wherein the address latch circuit is electrically connected to the decoder;

an address controller electrically connected to the address latch circuit;

an image data latch circuit electrically connected to the plurality of the pixels;

a write control circuit electrically connected to the image data latch circuit, the address latch circuit and the address controller; and a display control circuit electrically connected to the plurality of the pixels and the write control circuit, wherein the image data latch circuit is configured to be inputted a video signal, wherein the address controller is configured to be inputted a clock signal, wherein the write control circuit is configured to control writing the video signal to one of the plurality of memory circuits, and wherein the display control circuit is configured to control displaying image according to the video signal written in one of the plurality of memory circuits.

7. The display device according to claim 6, wherein each of the plurality of the pixels includes:

a light emitting element;

a first switch electrically connected to the light emitting element, and to the plurality of memory circuits;

a second switch electrically connected to the plurality of the memory circuits; and a signal line electrically connected to the second switch and the decoder.

8. The display device according to claim 7, wherein each of the plurality of the memory circuits includes a display memory circuit and a write memory circuit.

9. The display device according to claim 6, further comprising:

a display interface electrically connected to an image processing control register included in the address controller; and a CPU electrically connected to the display interface.

10. An electronic apparatus comprising the display device according to claim 6, wherein the electronic apparatus is one selected from the group consisting of a video camera, a notebook type personal computer, a portable information terminal, a sound reproducing device, a digital camera, and a mobile phone.

11. A display device comprising:

a plurality of pixels, each of which includes a plurality of memory circuits;

a first decoder for selecting one or more of columns in each of the plurality of pixels, wherein the first decoder is electrically connected to the plurality of the pixels;

a second decoder for selecting one or more of rows in each of the plurality of pixels, wherein the second decoder is electrically connected to the plurality of the pixels;

an address latch circuit for holding a potential of an address data or updating the potential of an address data, wherein the address latch circuit is electrically connected to the first decoder and to the second decoder;

an address controller electrically connected to the address latch circuit;

an image data latch circuit electrically connected to the plurality of the pixels;

a write control circuit electrically connected to the image data latch circuit, the address latch circuit and the address controller; and a display control circuit electrically connected to the plurality of the pixels and the write control circuit, wherein the image data latch circuit is configured to be inputted a video signal, wherein the address controller is configured to be inputted a clock signal, wherein the write control circuit is configured to control writing the video signal to one of the plurality of memory circuits, and wherein the display control circuit is configured to control displaying image according to the video signal written in one of the plurality of memory circuits.

12. The display device according to claim 11, wherein each of the plurality of the pixels includes:

a light emitting element;

a first switch electrically connected to the light emitting element, and to the plurality of memory circuits;

a second switch electrically connected to the plurality of the memory circuits; and a signal line electrically connected to the second switch and the first decoder.

13. The display device according to claim 12, wherein each of the plurality of the memory circuits includes a display memory circuit and a write memory circuit.

14. The display device according to claim 11, further comprising:

a display interface electrically connected to an image processing control register included in the address controller; and a CPU electrically connected to the display interface.

15. An electronic apparatus comprising the display device according to claim 11, wherein the electronic apparatus is one selected from the group consisting of a video camera, a notebook type personal computer, a portable information terminal, a sound reproducing device, a digital camera, and a mobile phone.

16. A display device comprising:

a plurality of pixels, each of which includes a plurality of memory circuits;

a decoder for selecting one or more of the memory circuits in each of the plurality of pixels, wherein the decoder is electrically connected to the plurality of the pixels;

an address latch circuit for holding a potential of an address data or updating the potential of an address data, wherein the address latch circuit is electrically connected to the decoder;

an address controller electrically connected to the address latch circuit;

an image data latch circuit electrically connected to the plurality of the pixels;

a write control circuit electrically connected to the image data latch circuit, the address latch circuit and the address controller; and a display control circuit electrically connected to the plurality of the pixels and the write control circuit, wherein the image data latch circuit is configured to be inputted a video signal, wherein the address controller is configured to be inputted a clock signal, wherein the write control circuit is configured to control writing the video signal to one of the plurality of memory circuits, and wherein the display control circuit is configured to control displaying image with a time division method according to the video signal written in one of the plurality of memory circuits.

17. The display device according to claim 16, wherein each of the plurality of the pixels includes:

a light emitting element;

a first switch electrically connected to the light emitting element, and to the plurality of memory circuits;

a second switch electrically connected to the plurality of the memory circuits; and a signal line electrically connected to the second switch and the decoder.

18. The display device according to claim 17, wherein each of the plurality of the memory circuits includes a display memory circuit and a write memory circuit.

19. The display device according to claim 16, further comprising:

a display interface electrically connected to an image processing control register included in the address controller; and a CPU electrically connected to the display interface.

20. An electronic apparatus comprising the display device according to claim 16, wherein the electronic apparatus is one selected from the group consisting of a video camera, a notebook type personal computer, a portable information terminal, a sound reproducing device, a digital camera, and a mobile phone.

21. A display device comprising:

a plurality of pixels, each of which includes a plurality of memory circuits;

a first decoder for selecting one or more of columns in each of the plurality of pixels, wherein the first decoder is electrically connected to the plurality of the pixels;

a second decoder for selecting one or more of rows in each of the plurality of pixels, wherein the second decoder is electrically connected to the plurality of the pixels;

an address latch circuit for holding a potential of an address data or updating the potential of an address data, wherein the address latch circuit is electrically connected to the first decoder and to the second decoder;

an address controller electrically connected to the address latch circuit;

an image data latch circuit electrically connected to the plurality of the pixels;

a write control circuit electrically connected to the image data latch circuit, the address latch circuit and the address controller; and a display control circuit electrically connected to the plurality of the pixels and the write control circuit, wherein the image data latch circuit is configured to be inputted a video signal, wherein the address controller is configured to be inputted a clock signal, wherein the write control circuit is configured to control writing the video signal to one of the plurality of memory circuits, and wherein the display control circuit is configured to control displaying image with a time division method according to the video signal written in one of the plurality of memory circuits.

22. The display device according to claim 21, wherein each of the plurality of the pixels includes:

a light emitting element;

a first switch electrically connected to the light emitting element, and to the plurality of memory circuits;

a second switch electrically connected to the plurality of the memory circuits; and a signal line electrically connected to the second switch and the first decoder.

23. The display device according to claim 22, wherein each of the plurality of the memory circuits includes a display memory circuit and a write memory circuit.

24. The display device according to claim 21, further comprising:

a display interface electrically connected to an image processing control register included in the address controller; and a CPU electrically connected to the display interface.

25. An electronic apparatus comprising the display device according to claim 21, wherein the electronic apparatus is one selected from the group consisting of a video camera, a notebook type personal computer, a portable information terminal, a sound reproducing device, a digital camera, and a mobile phone.

* * * * *